US005861859A

United States Patent [19]

Kanayama et al.

[11] Patent Number: 5,861,859

[45] **Date of Patent: *Jan. 19, 1999**

[54] ANTENNA ASSEMBLY AND PORTABLE RADIO APPARATUS

[75] Inventors: Yoshiki Kanayama, Saitama; Shinichiro Tsuda, Tokyo; Shinichi Kuroda, Saitama; Ichiro Toriyama; Hiroki Ito, both of Kanagawa, all of Japan

[73] Assignee: Sony Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 592,314

[22] PCT Filed: Jun. 27, 1995

[86] PCT No.: PCT/JP95/01279

§ 371 Date: May 23, 1996

§ 102(e) Date: May 23, 1996

[87] PCT Pub. No.: WO96/00990

PCT Pub. Date: Jan. 11, 1996

[30] Foreign Application Priority Data

Jun. 28, 1994 [JP] Japan ..... 6-170190

[51] Int. Cl.[6] ..... H01Q 1/36

[52] U.S. Cl. ..... 343/895; 343/702; 343/900

[58] Field of Search ..... 343/702, 895, 343/900; H01Q 1/24, 1/36

[56] References Cited

U.S. PATENT DOCUMENTS

| | | | |
|---|---|---|---|
| 4,868,576 | 9/1989 | Johnson | 343/895 X |
| 5,343,213 | 8/1994 | Kottke et al. | 343/702 |
| 5,438,339 | 8/1995 | Itoh et al. | 343/895 X |
| 5,479,178 | 12/1995 | Ha | 343/895 X |
| 5,548,827 | 8/1996 | Hanawa et al. | 343/702 |
| 5,612,704 | 3/1997 | Cole | 343/702 |

FOREIGN PATENT DOCUMENTS

| | | | |
|---|---|---|---|
| 0467822 | 7/1991 | European Pat. Off. | H04B 1/34 |
| 0511577 | 4/1992 | European Pat. Off. | H04B 1/38 |
| 621710 | 1/1994 | Japan | H01Q 1/24 |

*Primary Examiner*—Hoanganh Le
*Assistant Examiner*—Tho Phan
*Attorney, Agent, or Firm*—Jay H. Maioli

[57] ABSTRACT

An antenna assembly has a first helical antenna and a second rod antenna extending through inside said first antenna in the axis direction. When the antenna is retracted, the upper end of a conductive portion of the second antenna passes through the first antenna to be positioned below the lower end of the first antenna, and when the antenna is extended, the lower end portion of the conductive portion of the second antenna is electrically connected to the upper end portion of the first antenna. Therefore, the length of the second antenna can be reduced as compared with a length defined based on wavelengths of transmitted signals. Consequently, an antenna assembly which requires a smaller housing space can be obtained.

18 Claims, 36 Drawing Sheets

ANTENNA ASSEMBLY AND PORTABLE RADIO APPARATUS

TECHNICAL FIELD

This invention relates to an antenna assembly, and more particularly to an antenna assembly suitable for use in a compact portable radio apparatus.

BACKGROUND ART

In recent years, portable radio apparatuses have been reduced in size and weight. Accordingly, antenna assemblies used for such portable radio apparatuses are also required to be smaller. As an antenna assembly which satisfies the above requirements, many manufacturers are developing whip antennas which can be retracted into the housing body when it is used for communications. In earlier stage, portable radio apparatuses of relatively simple structure have utilized this type of whip antenna.

However, such a simple antenna has the following problem.

Specifically, the antenna, when extended from the housing body, is operative as a monopole antenna, whereas it cannot obtain a sufficient gain when retracted in the housing body. It can be considered that this is because the antenna retracted in the housing body is placed near the ground to cause an input impedance to increase, whereby impedance matching can not be established.

Thus, to improve the gain of the antenna when retracted in the housing body, a whip antenna of a so-called top loading type came into use instead of the simple whip antenna described above. The top loading type whip antenna refers to an antenna assembly which has a helical antenna electrically connected to the top end of a rod antenna.

When this type of whip antenna is extended from the housing body for use, radio waves can be radiated from both of the helical antenna and the rod antenna. When the antenna is retracted into the housing body, radio waves can be radiated from the helical antenna.

However, this type of whip antenna includes the rod antenna which does not contribute to the radiation of radio waves when it is retracted. The helical portion operates as an open stub.

The open stub may badly affect the input impedance of the antenna. Specifically, the open stub causes the impedance matching to be disrupted due to the distance between the rod antenna and a circuit board in the housing space and so on.

Thus, it cannot be said that this type of whip antenna is well designed. In addition, the whip antenna of top loading type, if not shielded completely, also has several problems, for example, that signals interfere from the retracted rod antenna and signals go into a shielded portion, and so on.

As a result of investigations for solving the above-mentioned problems, an antenna assembly has been developed, in which a rod antenna, when retracted into the housing body, is electrically isolated from a helical antenna. A prior art example of such an antenna assembly will be described with reference to FIGS. 1 to 6.

FIGS. 1 to 6 show two states of the antenna assembly equipped in a portable radio apparatus, that is, an extended state and a retracted state. It should be noted that in the drawings, illustration of the whole portable radio apparatus is omitted, and the antenna assembly and portions of the portable radio apparatus associated with the connection to the antenna assembly only are described. Also, corresponding parts in the various drawings are designated the same reference numerals.

First, the structure of an antenna assembly 1 shown in FIGS. 1 and 2 will be described. The antenna assembly 1 is composed of two antenna portions, that is, a rod antenna 1A and a helical antenna 1B. The rod antenna 1A is operative mainly when the antenna assembly 1 is extended from a housing body 2, while the helical antenna 1B is operative when the antenna assembly 1 is retracted into the housing body 2.

The antenna assembly 1 is attached to the housing body 2 by screwing an antenna connection fitting 1C on the antenna side into an antenna fixture 2A arranged in a non-metallic housing body 2.

The housing body 2 contains a circuit board 3 on which a variety of circuits as well as a power supply circuit 3A for the antenna assembly 1 are integrated. The power supply circuit 3A not only supplies the antenna assembly 1 with electric power through a power supply spring 3B but also has a function of matching a characteristic impedance of a transmitter/receiver circuit with an input impedance of the antenna assembly 1.

The power supply circuit 3A is, as shown in FIG. 1, electrically connected to the antenna assembly 1 when the antenna assembly 1 is extended from the housing body 2 and an extended-state limiter 1D arranged around a lower end portion of the rod antenna 1A is mechanically coupled to the antenna connection fitting 1C. Specifically, the power supply circuit 3A is electrically connected to the rod antenna 1A by way of the antenna fixture 2A, antenna connection fitting 1C, extended-state limiter 1D, and stopper 1E in that order.

In this way, the rod antenna 1A is brought into an operable state as a monopole antenna which has its ground level at the ground of the circuit board 3 and a shielding case.

Incidentally, the stopper 1E is provided for preventing the antenna assembly 1 from falling out. The extended-state limiter 1D and the stopper 1E are both made of a single metal part. The rod antenna 1A is caulked with the stopper 1E for establishing electrical and mechanical connection therebetween. Also, the rod antenna 1A is entirely covered with an antenna cover 1F or the like so as to prevent a human body from directly touching the rod antenna 1A.

On the other hand, when the antenna assembly 1 is retracted into the housing body 2 as shown in FIG. 2, the antenna connection fitting 1C is mechanically and electrically connected to a retracted-state limiter 1G, so that the helical antenna 1B can be powered from the power supply circuit 3A. In this state, the helical antenna 1B is operative as a helical antenna which has its ground level at the ground of the circuit board 3 and the shielding case.

The helical antenna 1B is also entirely covered with an antenna cover 1H so as to prevent a human body from directly touching it. The antenna cover 1H is utilized as a handle with which the user extends the antenna assembly 1, and also functions as a stopper for preventing the antenna assembly 1 from falling into the housing body of the radio apparatus when it is retracted.

As described above, since different antenna portions 1A, 1B individually operate when the antenna assembly 1 is extended and when it is retracted, favorable characteristics can be provided using the same matching circuit if impedances of the respective antenna portions are optimized.

An antenna assembly 4 shown in FIGS. 3 and 4 is also known as an antenna assembly which provides favorable characteristics as described above. Although the antenna assembly 4 is also composed of a rod antenna 4A and a helical antenna 4B, it differs from the antenna assembly 1 in the way each antenna is powered. More specifically, the helical antenna 4B is always powered from a power supply circuit 3A, while the rod antenna 4A is powered only when the antenna assembly 4 is extended.

When the antenna assembly 4 is extended from a housing body 2, the rod antenna 4A extends through the inside of the helical antenna 4B, as shown in FIG. 3. This causes the rod antenna 4A to electromagnetically couple to the helical antenna 4B, whereby the rod antenna 4A can be powered. In this state, the rod antenna 4A is operative as a monopole antenna which has its ground level at the ground of a circuit board 3 and a shielding case.

The rod antenna 4A is fixed to an antenna connection fitting 4C by an extended-state limiter 4E disposed near the lower end thereof when the antenna assembly 4 is extended. The extended-state limiter 4E is mechanically engaged with a non-metallic extended-state fixture 4D arranged in the antenna connection fitting 4C.

The rod antenna 4A and the helical antenna 4B of this example are also covered with antenna covers 4G and 4H, respectively, so as to prevent a human body from directly touching them. A non-metallic stopper 4F is provided for preventing the antenna assembly 4 from falling out.

FIG. 4 shows connections at various portions of the antenna assembly 4 when it is retracted in the housing body 2. When the antenna assembly 4 is retracted into the housing body 2, the antenna assembly 4 is fixed by a retracted-state limiter 4J formed near the top end of the antenna assembly 4 which is mechanically engaged with a retracted-state fixture 4I arranged in the antenna cover 4G. In this state, since the distance G from a handle 4K to the upper end of the rod antenna 4A is larger than the length HL of the helical antenna 4B, the upper end of the rod antenna 4A is located below an antenna fixture 2A, so that the rod antenna 4A is electrically isolated from the helical antenna 4B. Therefore, the helical antenna 4B only is operative in the retracted state of the antenna assembly 4.

The helical antenna 4B is operative as a helical antenna which has its ground level at the ground of the circuit board 3 and the shielding case. The handle 4K also serves as a stopper for preventing the antenna assembly 4 from falling into the housing body 2. The antenna assembly 4 thus constructed also provides favorable characteristics when it is extended as well as when it is retracted.

An antenna assembly 5 shown in FIGS. 5 and 6 is also known as an antenna assembly which provides favorable characteristics, similarly to the above-mentioned ones. The antenna assembly 5 has substantially the same structure as the antenna assembly shown in FIGS. 3 and 4. The feature of the antenna assembly 5 lies in that a rod antenna 5A operable when the antenna assembly 5 is extended is not powered through electromagnetic coupling but through mechanical and electrical connection.

More specifically, when the antenna assembly 5 is extended from a housing body 2, the rod antenna is fixed by mechanical and electrical connection of an extended-state limiter 5B arranged near the lower end of the rod antenna 4A to an antenna connection fitting 5A. The rest of the structure is similar to that of the antenna assembly 4. In addition, a stopper 5C is also provided for preventing the antenna assembly 5 from falling out.

After the antenna assembly 5 is extended from the housing body 2, the rod antenna 4A is mainly operative as an antenna which has its ground level at the ground of a circuit board 3 and a shielding case. Although a helical antenna 4B is also powered in this state, it is operative as a supplement to the rod antenna 4A.

On the other hand, when the rod antenna 4A is retracted into the housing body 2, the rod antenna 4A is electrically isolated from the helical antenna 4B since the distance G from a handle 4K to the upper end of the rod antenna 4A is larger than the length HL of the helical antenna 4B. As a result, the helical antenna 4B only is operable in the retracted state. In this way, the antenna assembly 5 favorably operates when it is extended as well as when it is retracted.

However, the above-mentioned three kinds of antenna assemblies 1, 4, 5 present a problem associated with a reduction in size of the portable radio apparatus. The problem is caused by the fact that the antenna length L must be shorter than the length of the housing body 2 for housing the rod antenna 1B or 4A in the housing body 2. However, since the antenna length L is essentially determined from wavelengths of used frequencies, it cannot be made shorter in order to reduce the size of the housing body 2. Generally, the antenna length L should be approximately one quarter to one half of wavelengths of communication frequencies.

Therefore, if a portable radio apparatus is to be made smaller, an antenna assembly designed according to the conventional scheme may not be completely housed within the housing body of the radio apparatus. For example, when the antenna assembly shown in the prior art example is used in a portable radio apparatus for a frequency band of 800 [MHz], the antenna length L must be approximately 90 [mm] even if it is one-quarter wavelength. Thus, the antenna assembly cannot be used in a portable radio apparatus with a housing body, the size of which is 90 [mm] or less.

Also, with the antenna assembly 5 having the structure shown in FIGS. 5 and 6, when the rod antenna 4A is extended, the rod antenna 4A and the helical antenna 4B are always connected simultaneously to the antenna fitting 5A, so that the rod antenna 4A is not operative as a simple monopole antenna. This constitutes the cause of lower design freedom.

DISCLOSURE OF INVENTION

The present invention relates to an antenna assembly and a portable radio apparatus using the assembly that solves the problem described above.

According to the present invention, an antenna assembly has a first helical antenna and a second rod antenna extensible through the inside of the first antenna in the axial direction, in which the upper end of a conductive portion of the second antenna passes through the first antenna and positioned below the lower end of the first antenna when the second antenna is retracted, and a lower end portion of a conductive portion of the second antenna is electrically connected to an upper end portion of the first antenna when the second antenna is extended.

In this way, in the antenna assembly according to this invention, when the second rod antenna is extended, the lower end of the second antenna is electrically connected to the upper end of the first antenna, so that the two antennas are operative as an apparently single antenna. Thus, the length of the second antenna can be shorter than a length determined based on radio communication frequency. Therefore, a space for housing the antenna can be reduced correspondingly.

Further, according to this invention, an antenna assembly has a first helical antenna and a second rod antenna positioned coaxially with the first antenna, in which the second antenna is composed of a fixed portion and a movable portion, and when the movable portion which extends through the inside of the fixed portion in the axial direction, a lower end portion of the movable portion of the second antenna is electrically connected to an upper end portion of the fixed portion.

In this way, in the antenna assembly according to the present invention, when the movable portion is extended, the lower end portion of the movable portion is electrically connected to the upper end portion of the fixed portion, so that these portions are operative as an apparently single antenna. Thus, the length of the movable portion can be made still shorter than a length determined based on radio communication frequency, and therefore a housing space can be further reduced correspondingly.

BEST MODE FOR CARRYING OUT THE INVENTION

Embodiments of the present invention will hereinafter be described with reference to the accompanying drawings.

(1) First Embodiment

Figure 1:
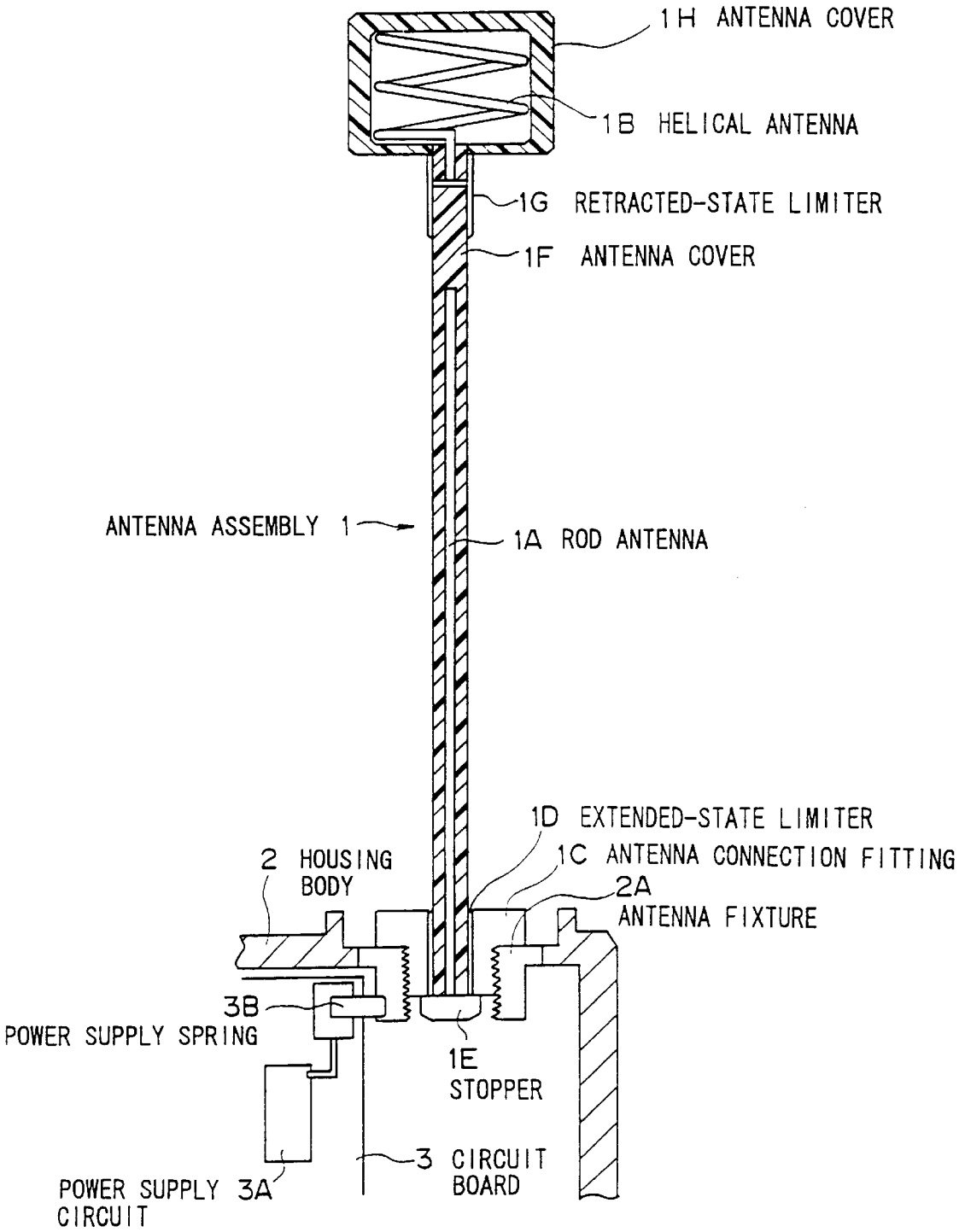
FIG. 1 (PRIOR ART)
FIG. 1 is a cross-sectional view showing the connections of various portions when an antenna is used in the extended state in a conventional antenna assembly.
Figure 2:
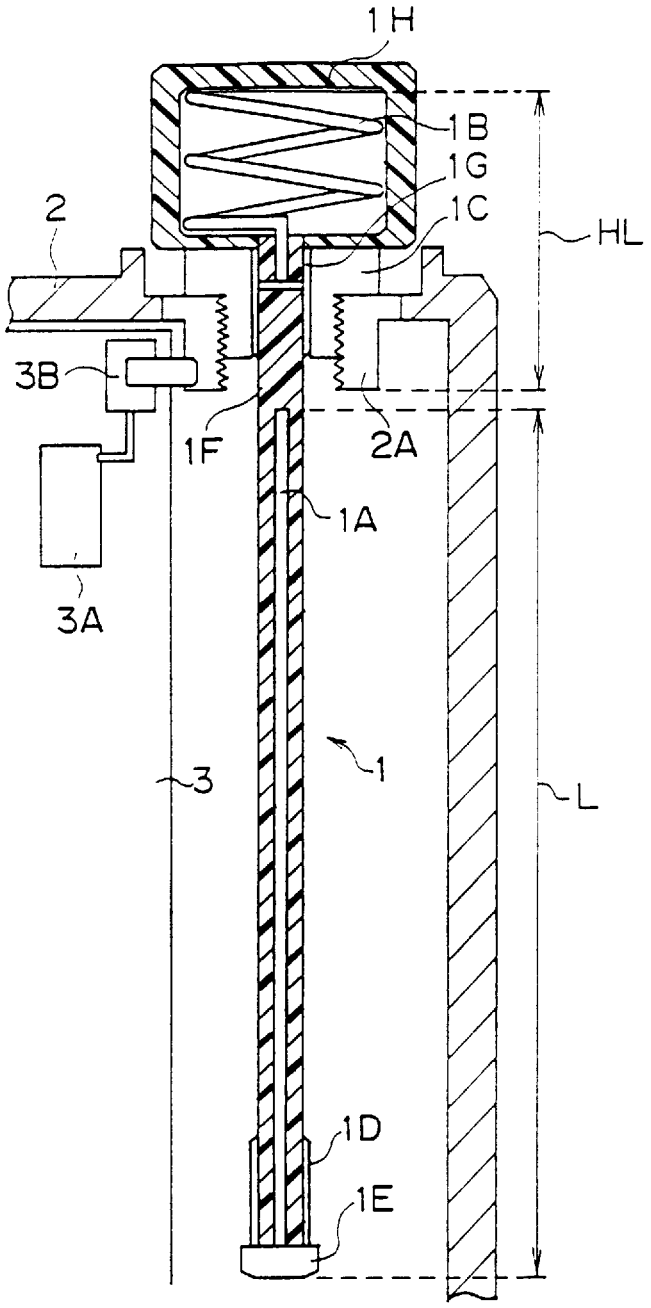
FIG. 2 (PRIOR ART)
FIG. 2 is a cross-sectional view showing the connections of various portions when the antenna is used in the retracted state in a conventional antenna assembly.
Figure 3:
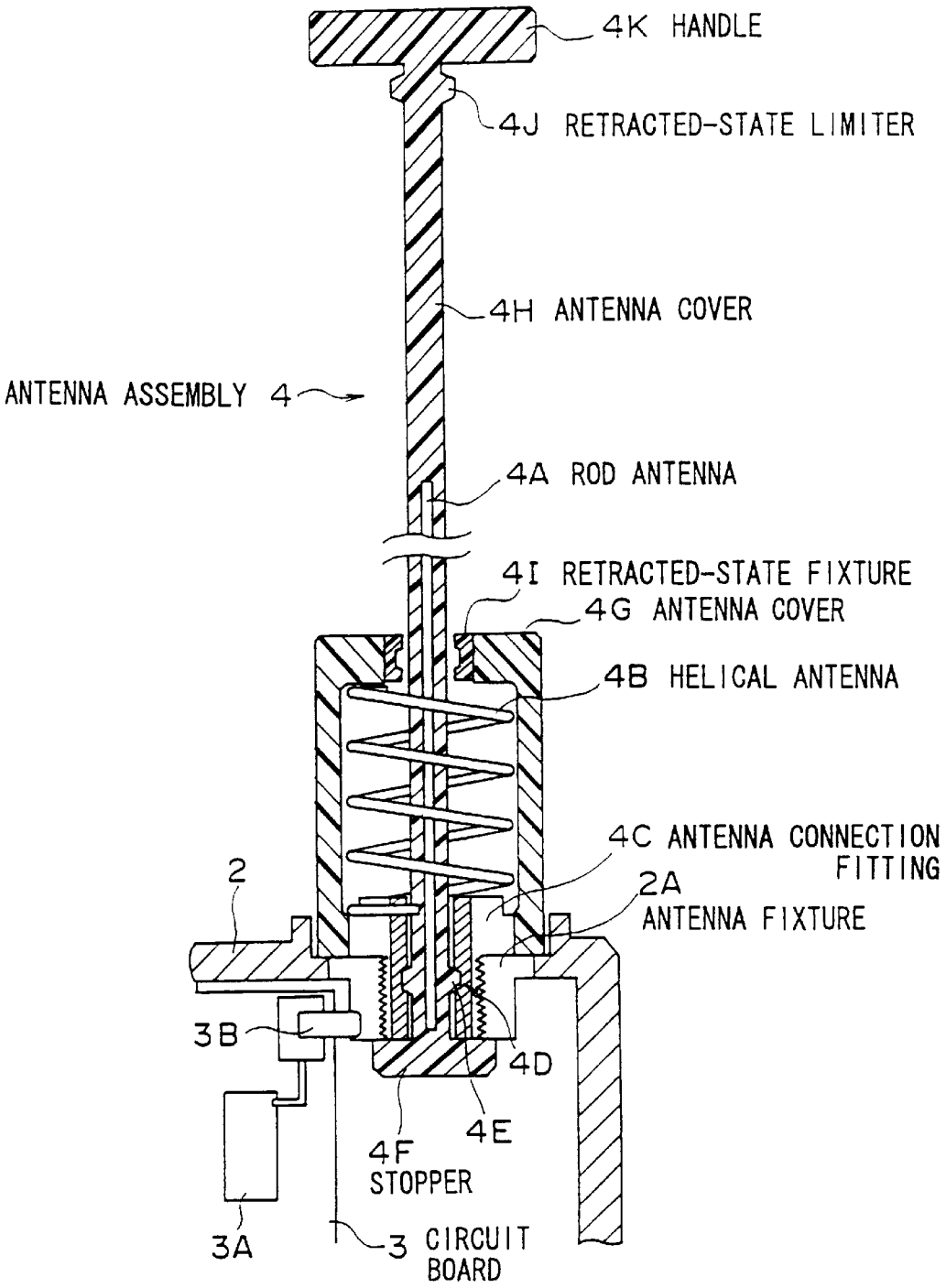
FIG. 3 (PRIOR ART)
FIG. 3 is a cross-sectional view showing the connections of various portions when a second antenna is used in the extended state in a conventional antenna assembly.
Figure 4:
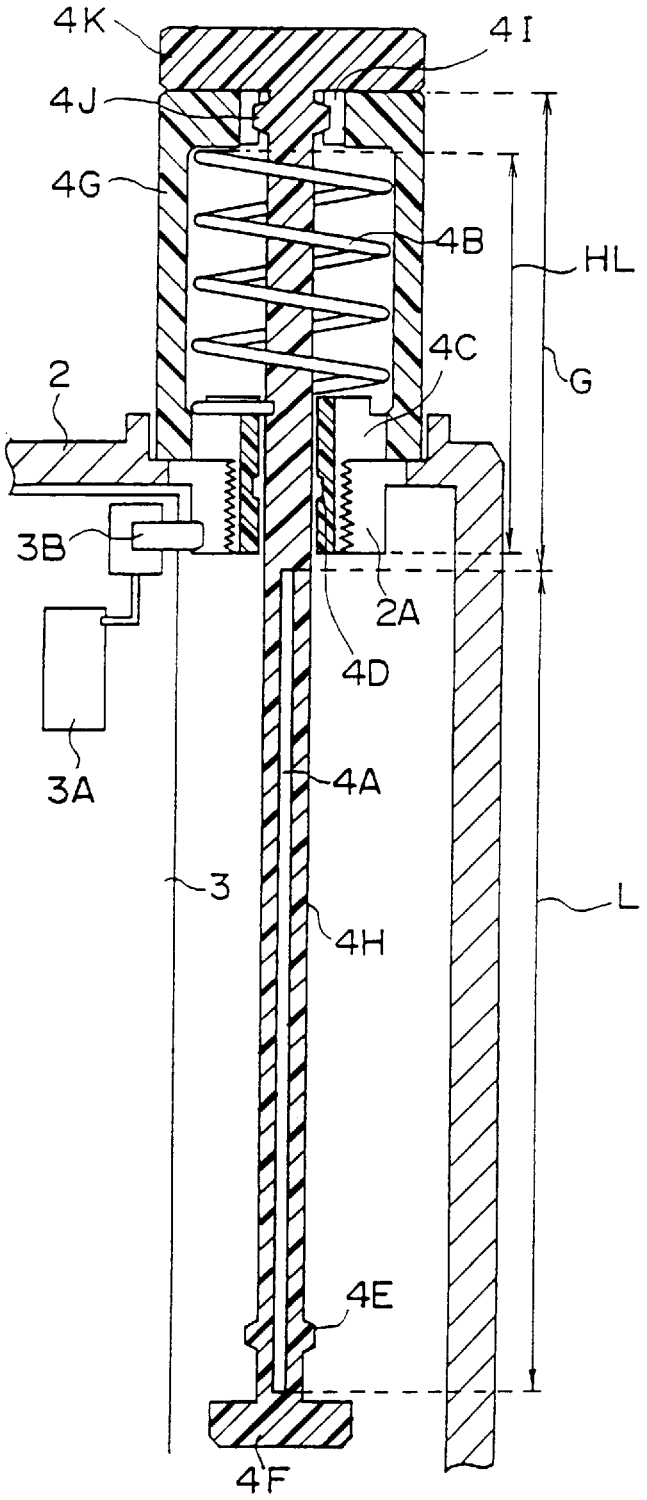
FIG. 4 (PRIOR ART)
FIG. 4 is a cross-sectional view showing the connections of various portions when the second antenna is used in the retracted state in a conventional antenna assembly.
Figure 5:
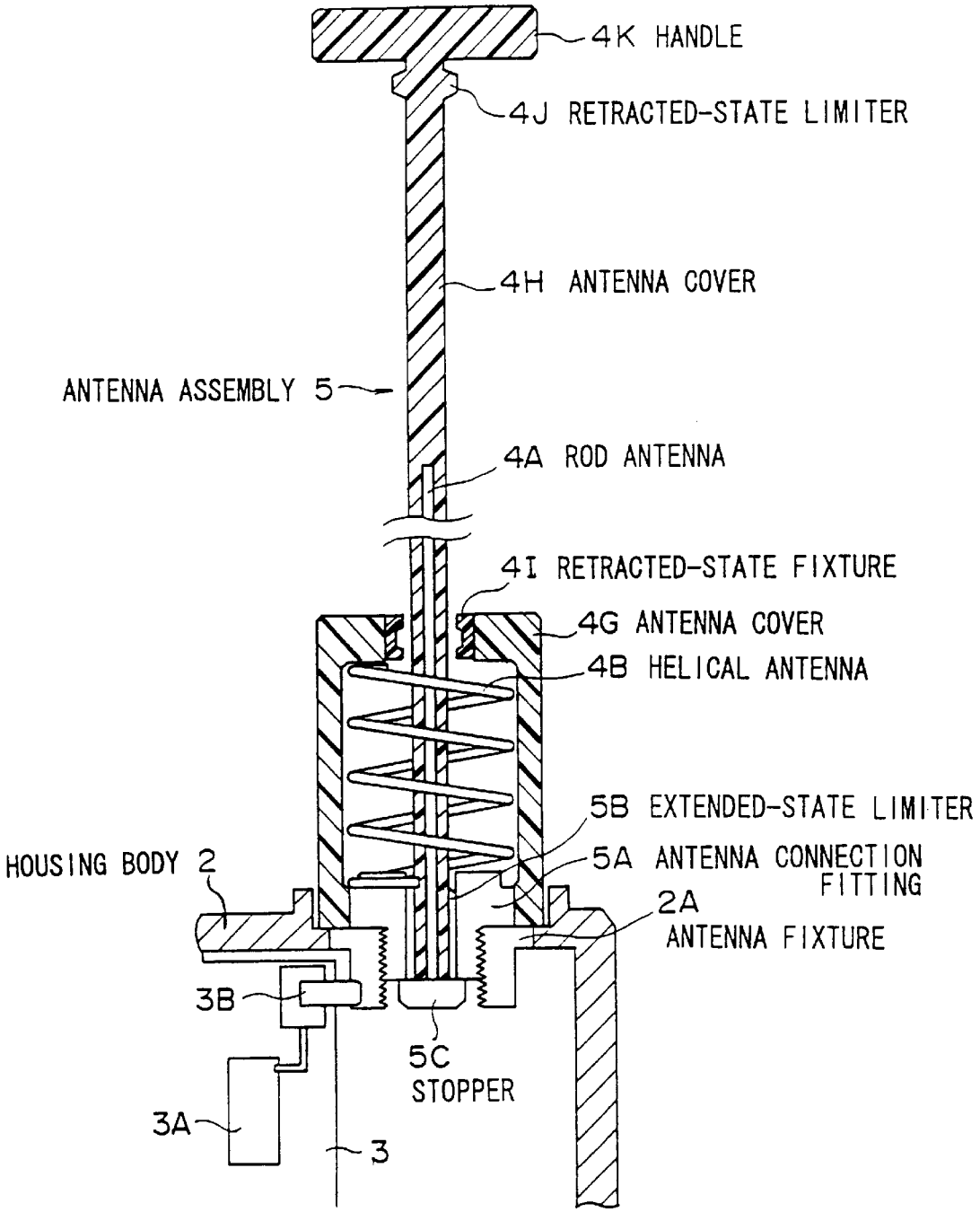
FIG. 5 (PRIOR ART)
FIG. 5 is a cross-sectional view showing the connections of various portions when a third antenna is used in the extended state in a conventional antenna assembly.
Figure 6:
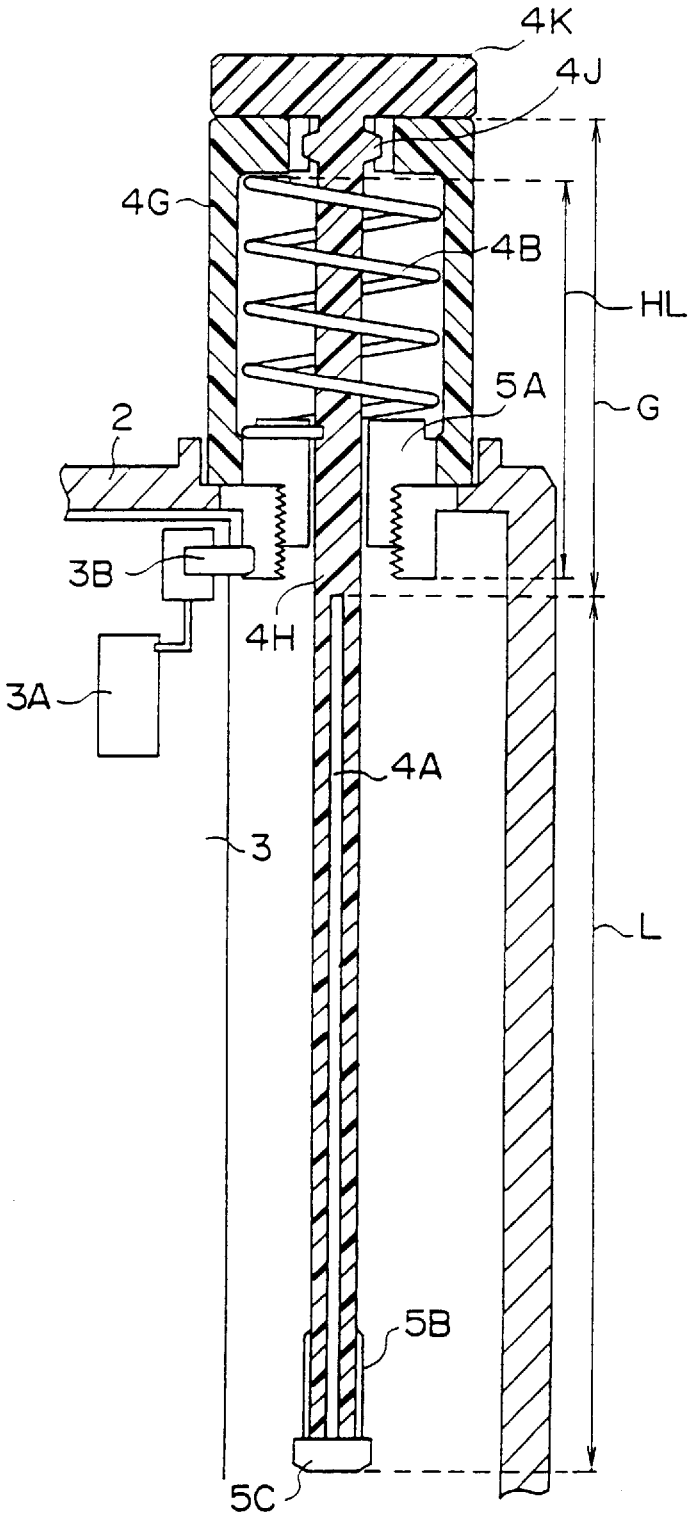
FIG. 6 (PRIOR ART)
FIG. 6 is a cross-sectional view showing the connections of various portions when the antenna is used in the retracted state in a conventional antenna assembly.
Figure 7:
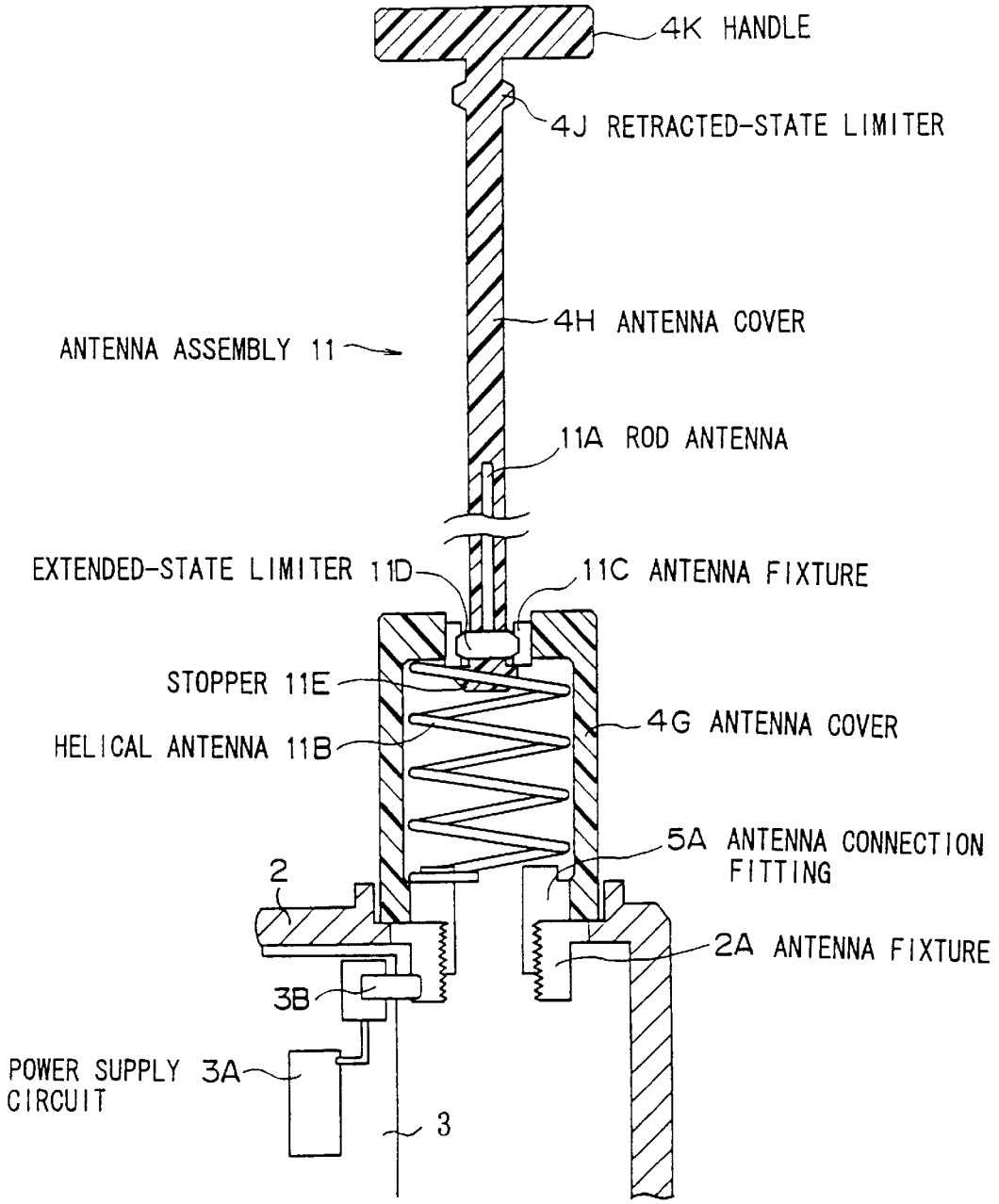
FIG. 7 is a cross-sectional view showing the connections of various portions when the first embodiment antenna is used in the extended state in an antenna assembly according to this invention.
Figure 8:
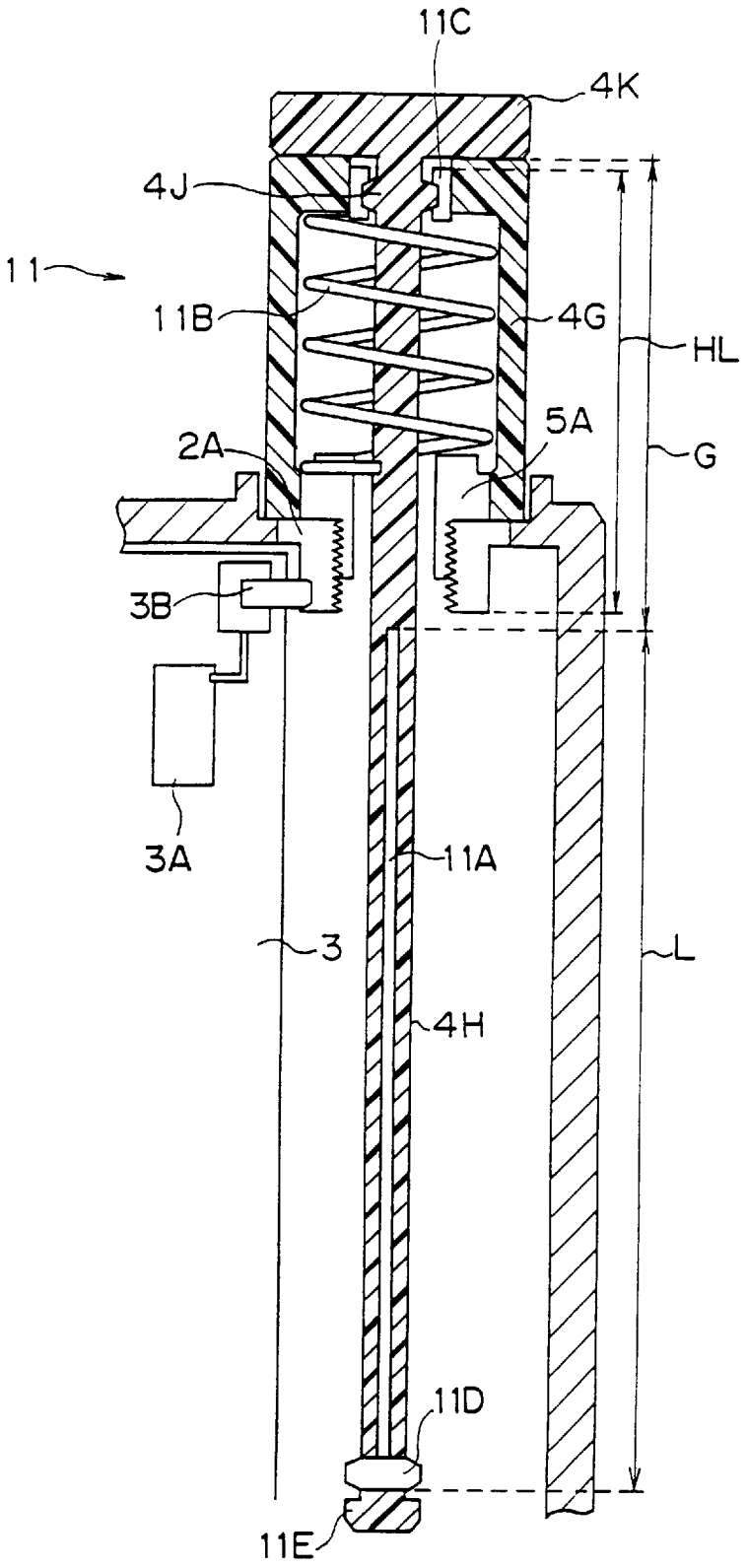
FIG. 8 is a cross-sectional view showing the connections of various portions when the antenna is used in the retracted state in the antenna assembly of FIG. 7.

In FIGS. 7 and 8, an antenna assembly is generally designated reference numeral 11. It should be noted that parts in FIGS. 7 and 8 corresponding to those in FIGS. 5 and 6 are designated the same reference numerals. The antenna assembly 11 is composed of two antenna portions, i.e., a rod antenna 11A and a helical antenna 11B. These two antenna portions are connected such that the rod antenna 11A is mainly operative when the antenna assembly 11 is extended, whereas the helical antenna 11B is always operative.

The antenna assembly 11 of this embodiment, however, differs from the prior art in the way the rod antenna 11A is powered. Specifically, the rod antenna 11A is not powered through an antenna connection fitting 5A and an extended-state limiter 5B, but through an antenna fixture 11C and an extended-state limiter 11D which are connected to the top end part of the rod antenna 11B. Stated another way, when the antenna is extended, the rod antenna 11A and the helical antenna 11B are combined to operate as a combined antenna. This is the reason that the length L of the rod antenna 11A can be made shorter.

The antenna assembly 11 is attached to a housing body 2 by the connection fitting 5A.

More specifically, the antenna assembly 11 is attached to the housing body 2 by screwing an antenna connection fitting 5A on the antenna side into an antenna fixture 2A arranged in a non-metallic housing body 2.

The housing body 2 contains a circuit board 3 on which a variety of circuits as well as a power supply circuit 3A are integrated. The power supply circuit 3A not only supplies the antenna assembly 11 with electric power through a power supply spring 3B but also has a function of matching a characteristic impedance of a transmitter/receiver circuit with an input impedance of the antenna assembly 11.

It should be noted that the two antennas constituting the antenna assembly 11, i.e., the rod antenna 11A and the helical antenna 11B have their surfaces covered with antenna covers 4H and 4G, respectively, such that a human body is prevented from directly touching the antennas.

The rod antenna 11A is provided around a lower end portion thereof with a stopper 11E for preventing same from falling out.

With the structure described above, the operation of the antenna assembly 11 will be next described for two cases: when the antenna assembly 11 is used with the rod antenna extended from the housing body 2 (extended state) and with the rod antenna left retracted in the housing body 2 (retracted state).

First, when the antenna assembly 11 is used with the rod antenna extended from the housing body 2 (FIG. 7), a power supply line between the power supply circuit 3A and the antenna assembly 11 is formed through mechanical and electrical connection between the retracted-state limiter 11D arranged around a lower end portion of the rod antenna 11A and the antenna fixture 11C.

More specifically, the power supply circuit 3A is electrically connected to the rod antenna 11A through the power supply spring 3B, antenna fixture 2A, antenna connection fitting 5A, and helical antenna 11B in order.

The rod antenna 11A is thus connected in series with the helical antenna 11B, whereby the two antennas 11A and 11B are operative as a combined antenna. This combined antenna has its ground level at the ground of the circuit board 3 and the shielding case.

On the other hand, when the antenna assembly 11 is used with the rod antenna 11A retracted in the housing body 2 (FIG. 8), a retracted-state limiter 4J is engaged with a recess formed in the antenna fixture 11C. In this state, if the distance G from a handle 4K to the upper end of the rod antenna 11A is set larger than the length HL of the helical antenna 11B, the upper end of the retracted rod antenna 11A is located below the antenna connection fitting 5A.

Thus, the rod antenna 11A, when retracted, is electrically isolated from the helical antenna 11B, with the result that the always powered helical antenna 11B is only operable. In this event, the helical antenna 11B is operative as a helical antenna which has its ground level at the ground of the circuit board 3 and the shielding case.

As described above, the rod antenna 11A and the helical antenna 11B are operative as a single antenna when the antenna assembly 11 is extended, while the helical antenna 11B is only operative when the rod antenna 11A is retracted. Consequently, favorable radiation can be realized in both cases when the antenna is extended and the antenna is retracted.

According to the foregoing structure, since the combined antenna formed of a series connection of the helical antenna 11B fixed to the housing body 2 and the rod antenna 11A can be used as a transmission/reception antenna when the rod antenna 11A is extended, the length L of the rod antenna 11A can be made shorter than one-quarter wavelength. This structure allows the realization of an antenna assembly having a length shorter than prior art antenna assemblies, i.e., an antenna assembly requiring a smaller housing space and hence a portable radio apparatus equipped with such a shorter antenna assembly.

Further, since the rod antenna 11A is connected to extend upward from the upper end of the helical antenna 11B, overlapping of the rod antenna 4A and the helical antenna 4B, as is the case of the prior art examples, can be eliminated. Therefore, when the rod antenna 11A having the same length as the prior art example is used, the antenna length can be made longer in its extended state, thus improving the sensitivity of the antenna assembly and the portable radio apparatus as compared with the prior art.

(2) Second Embodiment

Figure 9:
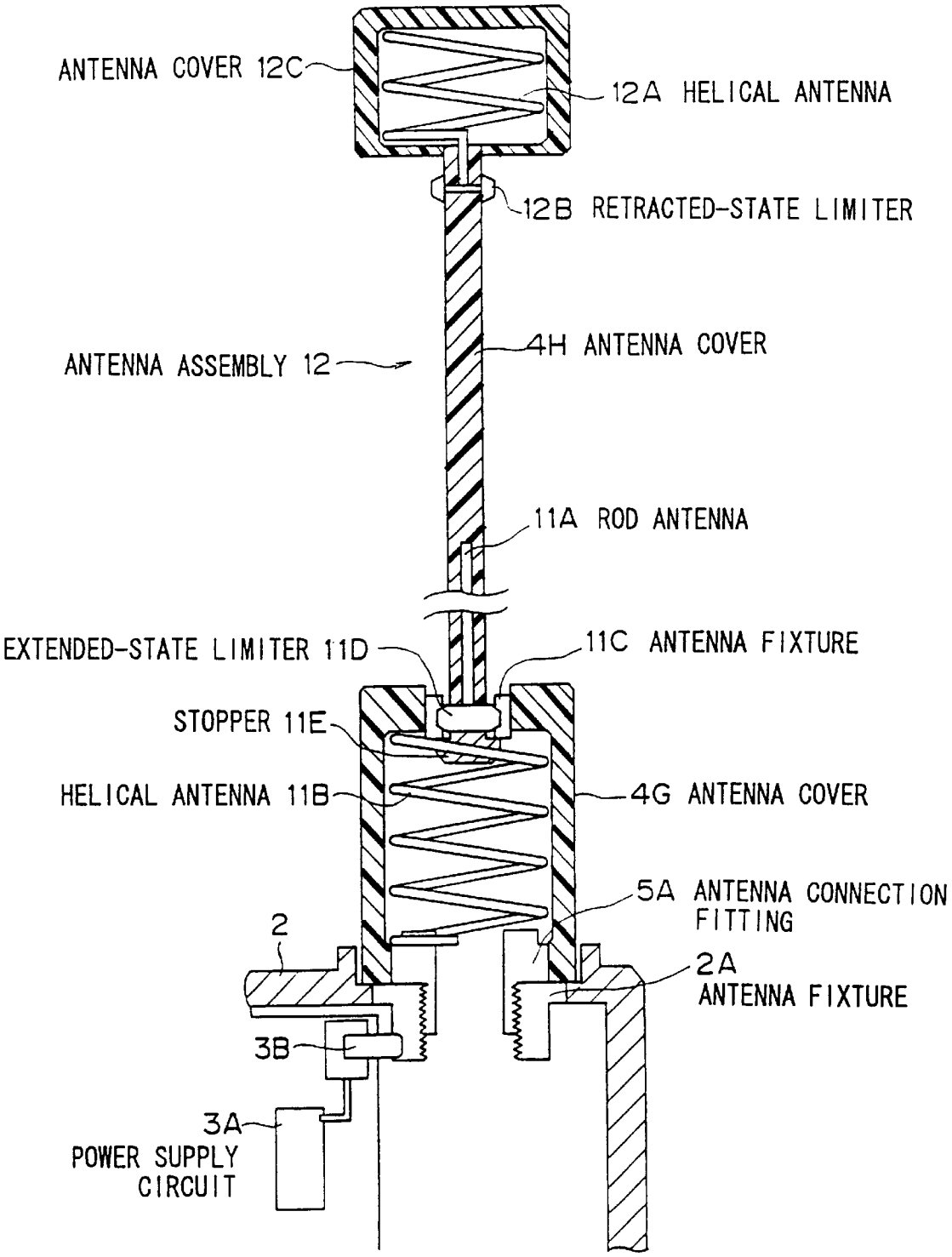
FIG. 9 is a cross-sectional view showing the connections of various portions when the antenna is used in the extended state in the antenna assembly according to a second embodiment of this invention.
Figure 10:
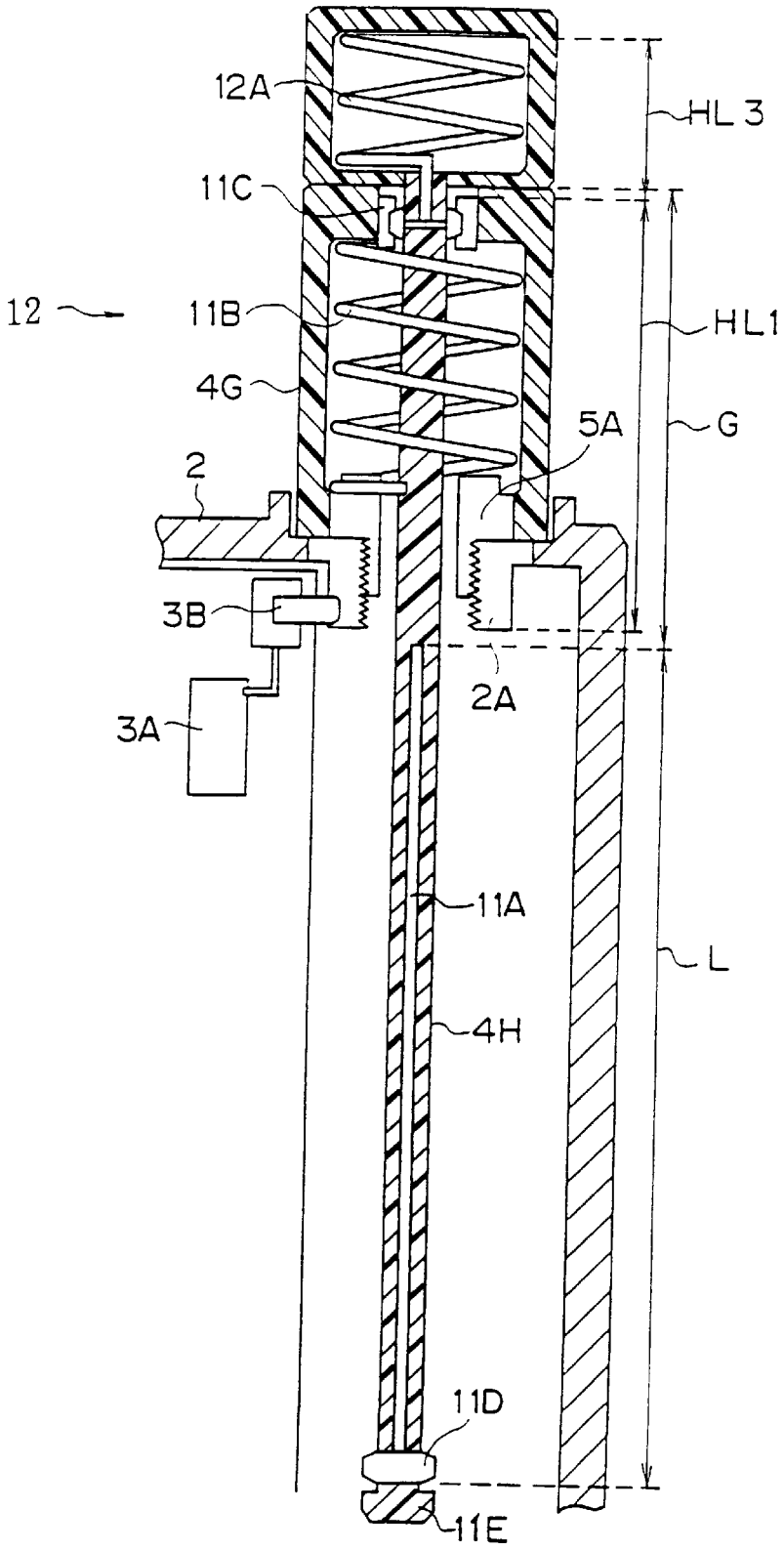
FIG. 10 is a cross-sectional view showing the connections of various portions when the antenna is used in the retracted state in the antenna assembly of FIG. 9.

In FIGS. 9 and 10, in which parts corresponding to those in FIGS. 7 and 8 are designated the same reference numerals, reference numeral 12 generally indicates an antenna assembly of this embodiment. The antenna assembly 12 has a structure similar to that of the antenna assembly 11 described in the previous section, except that a second helical antenna 12A is additionally provided in a handle.

More specifically, when the antenna assembly 12 is retracted into a housing body 2, the helical antenna 12A arranged in the handle is electrically connected in series with a helical antenna 11B fixed to the housing body 2 through a retracted-state limiter 12B and an antenna fixture 11C, such that the two helical antennas are operative as a single antenna. The remaining structure of the antenna assembly 12 is similar to that of the antenna assembly 11. The helical antenna 12A in the handle is also covered with an antenna cover 12C so as to prevent a human body from directing touching it.

With the foregoing structure, the operation of the antenna assembly 12 will be described for two cases: when the antenna assembly 12 is used extended from the housing body 2 (extended state) and when it is used left retracted in the housing body 2 (retracted state).

First, when the antenna assembly 12 is used in the extended state (FIG. 9), a rod antenna 11A is powered from a power supply circuit 3A through mechanical and electrical connection of an extended-state limiter 11D arranged around a lower end portion of the rod antenna 11A to the antenna fixture 11C.

More specifically, the power supply circuit 3A is electrically connected to the rod antenna 11A through a power supply spring 3B, antenna fixture 2A, antenna connection fitting 5A, and helical antenna 11B in order.

This results in a series connection of the rod antenna 11A with the helical antenna 11B, whereby the two antennas 11A and 11B are operative as a single combined antenna. This combined antenna operates with its ground level taken at the ground of a circuit board 3 and a shielding case.

On the other hand, when the antenna assembly 12 is used with the rod antenna 11A left retracted in the housing body 2 (FIG. 10), the retracted-state limiter 12B is engaged with a recess formed in the antenna fixture 11C to establish electrical and mechanical connection therebetween. This causes the second helical antenna 12A in the handle to be electrically connected in series with the helical antenna 11B on the housing body side, whereby the two helical antennas are operative as a single antenna.

If the distance G from the upper end of the antenna cover 4G to the upper end of the rod antenna 11A is made larger than the length HL1 of the helical antenna 11B in the retracted state, the upper end of the retracted rod antenna 11A is located below the antenna connection fitting 5A.

Thus, the electromagnetic coupling between the rod antenna 11A and the helical antenna 11B is not produced, so that the two antennas 11A and 11B are electrically isolated from each other. Consequently, the helical antennas 11B and 12A, which are connected with each other through the antenna fixture 11C and the retracted-state limiter 12B, are only placed in an operable state. In this event, the two helical antennas 11B and 12A are operative as a single helical antenna which has its ground level at the ground of the circuit board 3 and a shielding case.

In this way, the rod antenna 11A and the helical antenna 11B are operative as a single antenna when the antenna assembly 12 is in the extended state, while the two helical antennas 11B and 12A are operative as a single antenna when the antenna assembly 12 is in the retracted state. Consequently, favorable radiation can be realized in both cases when the antenna is extended and the antenna is retracted.

According to the foregoing structure, the following advantages can be obtained in addition to those described in connection with the first embodiment in the previous section. That is, by setting parameters so as to provide the rod antenna 11A and the helical antenna 12A in the handle with the same electrical characteristics, it is possible to present substantially the same input impedance characteristics when the antenna assembly 12 is in the extended state and in the retracted state. This results in realizing favorable radiation characteristics in both the states by using a single matching circuit.

(3) Third Embodiment

Figure 11:
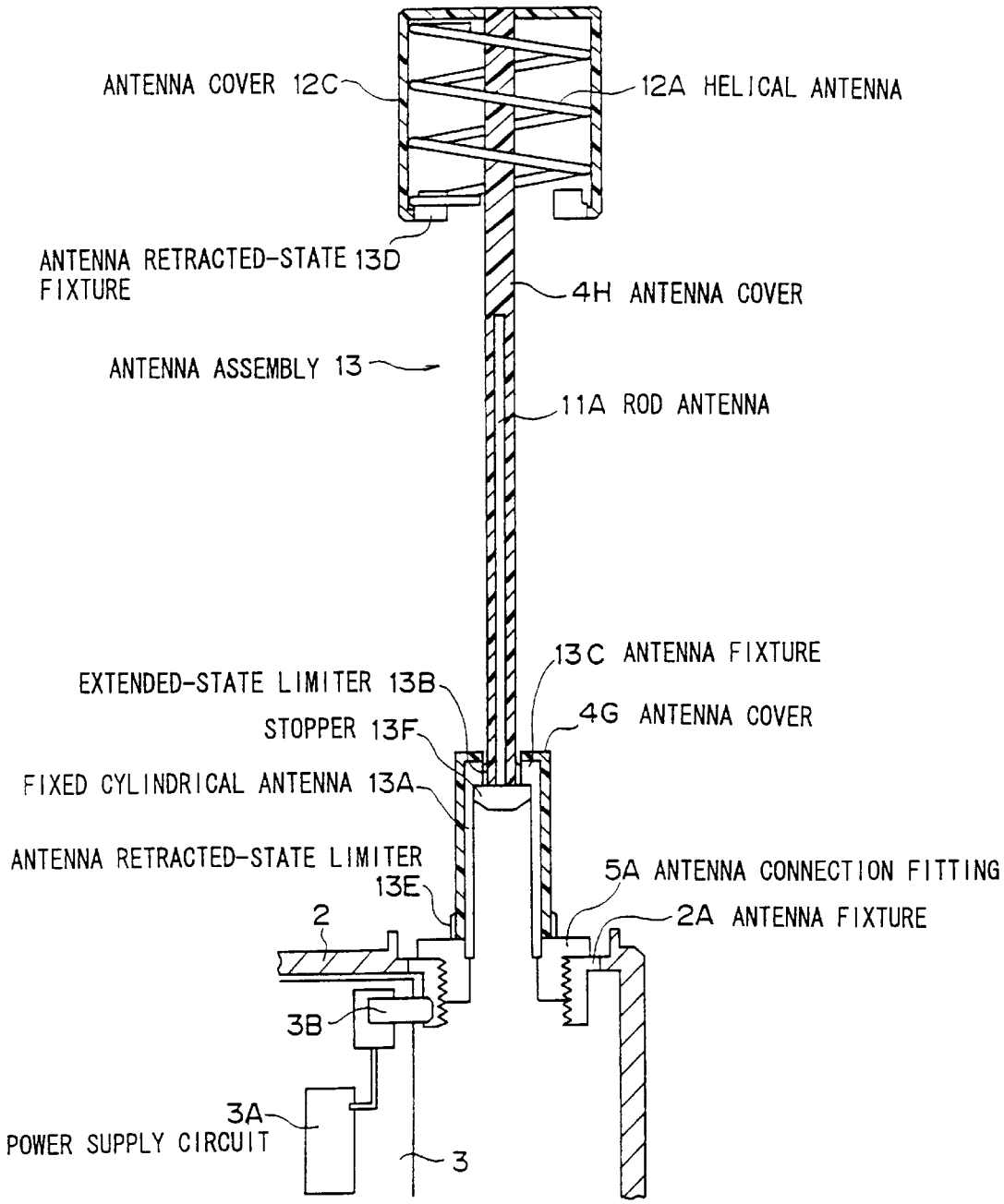
FIG. 11 is a cross-sectional view showing the connections of various portions when the antenna is used in the extended state in an antenna assembly according to a third embodiment of this invention.
Figure 12:
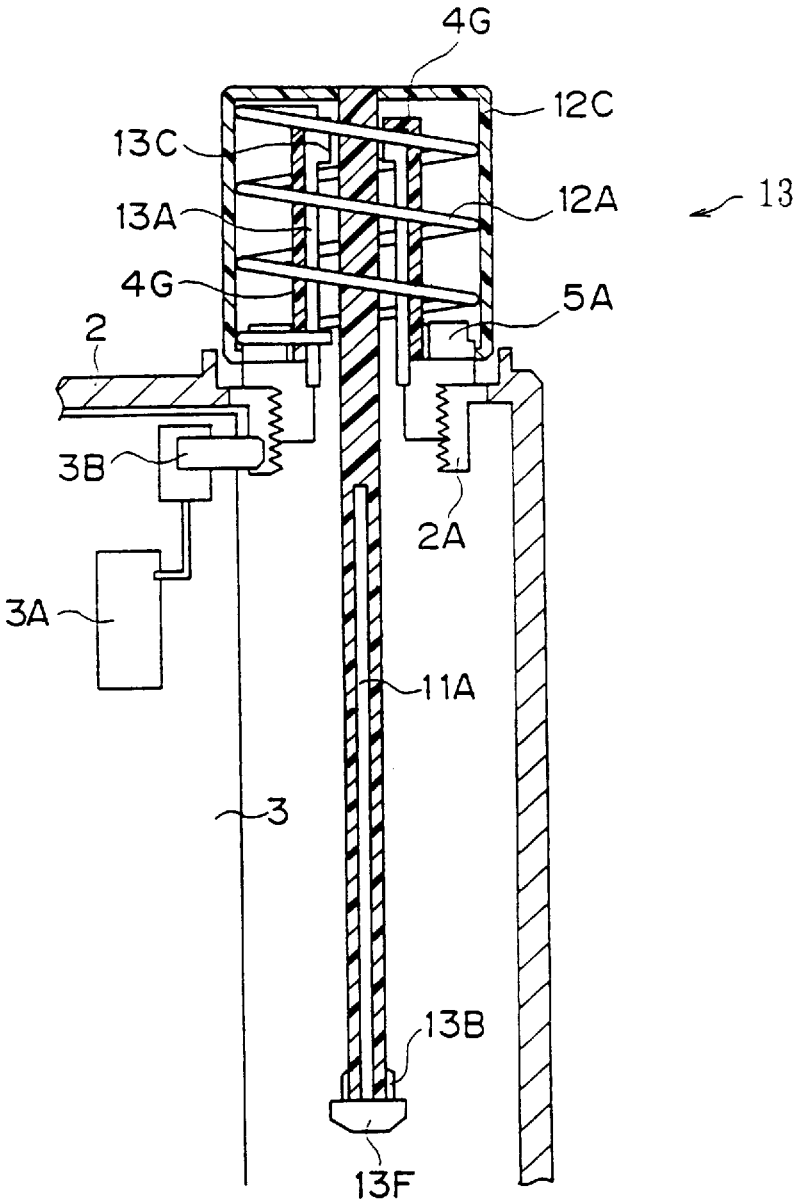
FIG. 12 is a cross-sectional view showing the connections of various portions when the antenna is used in the retracted state in the antenna assembly of FIG. 11.

In FIGS. 11 and 12, in which parts corresponding to those in FIGS. 9 and 10 are designated the same reference numerals, reference numeral 13 generally indicates an antenna assembly of this embodiment. The antenna assembly 13 basically differs from the antenna assembly 12 in that the former has a cylindrical antenna 13A fixed to a housing body 2 and the helical antenna is movable.

More specifically, the antenna assembly 13 features that when a rod antenna 11A is fully extended from the housing body 2, the rod antenna 11A is electrically and mechanically connected to the top of the fixed cylindrical antenna 13A, whereby the two antennas 11A and 13A are operative as a monopole antenna.

It should be noted however that the inner diameter of a helical antenna 12A arranged at the tip of the antenna assembly 13 is larger than the outer diameter of the fixed cylindrical antenna 13A. Therefore, even when the antenna is retracted, the antenna is vertically movable with a predetermined spacing without interference between the inner periphery of the helical antenna 12A and the outer periphery of the fixed cylindrical antenna 13A. The helical antenna 12A is electrically connected with an antenna connection fitting 5A attached in the housing body 2 and is powered, when the antenna is retracted entirely. Stated another way, when the rod antenna 11A is retracted in the housing body 2, the helical antenna 12A is powered via an antenna retracted-state fixture 13D and a power supply circuit 3A to be operable as a helical antenna.

The lower end of the helical antenna 12A is mechanically and electrically connected to the antenna retracted-state fixture 13D.

The lower end of the fixed cylindrical antenna 13A is also mechanically and electrically connected to the antenna connection fitting 5A. With this structure, the fixed cylindrical antenna 13A can be powered from the power supply circuit 3A.

The surface of the helical antenna 12A is covered with an antenna cover 12C. The antenna cover 12C is also used as a handle for extending the rod antenna 11A as well as serves as a stopper for preventing the antenna assembly 13 from falling into the housing body 2 when it is retracted. The antenna retracted-state fixture 13D described above is mechanically fixed to the antenna cover 12C.

The surface of the fixed cylindrical antenna 13A, in turn, is covered with an antenna cover 4G. An antenna retracted-state limiter 13E is attached to a base portion of the antenna cover 4G for fixing the helical antenna 12A when the antenna is retracted.

With the foregoing structure, the operation of the antenna assembly 13 will be described for two cases: when the antenna assembly 13 is used with the rod antenna 11A extended from the housing body 2 (extended state) and with the rod antenna 11A left retracted in the housing body 2 (retracted state).

First, when the antenna assembly 13 is used in the extended state (FIG. 11), an extended-state limiter 13B is mechanically and electrically connected to an antenna connection fitting 13C attached to an end portion of the fixed cylindrical antenna 13A, thus forming a power supply line between a power supply circuit 3A and the rod antenna 11A.

In this way, the rod antenna 11A is connected in series with the fixed cylindrical antenna 13A to form a linear antenna. In other words, the rod antenna 11A and the fixed cylindrical antenna 13A are operative as a monopole antenna which has its ground level at the ground of a circuit board 3 and a shielding case. Incidentally, a stopper 13F is provided at the lower end of the rod antenna 11A for preventing the user from pulling out the antenna assembly 13.

On the other hand, when the antenna is used in the retracted state in the housing body 2 (FIG. 12), the antenna retracted-state fixture 13D fixed to the lower portion of the antenna cover 12C is mechanically and electrically connected to the antenna retracted-state limiter 13E, whereby the helical antenna 12A is operative as an antenna electrically connected to the power supply circuit 3A. In this state, the rod antenna 11A is retracted in the housing body 2. In addition, the upper end of the rod antenna 11A is located below the antenna connection fitting 5A.

Thus, there is no electrical connection between the rod antenna 11A and the fixed cylindrical antenna 13A, and only the helical antenna 12A operates as a helical antenna which has its ground level at the ground of the circuit board 3 and the shielding case.

As described above, the rod antenna 11A and the fixed cylindrical antenna 13A are operative as a monopole antenna when the rod antenna 11A is extended, while the helical antenna 12A is operative as a single helical antenna when the rod antenna 11A is retracted. Consequently, favorable radiation can be realized in either of the two cases.

The foregoing structure according to the third embodiment can realize an antenna assembly and a portable radio apparatus which can reduce the length of an antenna housing space within the housing body by the length of the fixed cylindrical antenna 13A which protrudes upward from the top surface of the housing body 2.

(4) Fourth Embodiment

Figure 13:
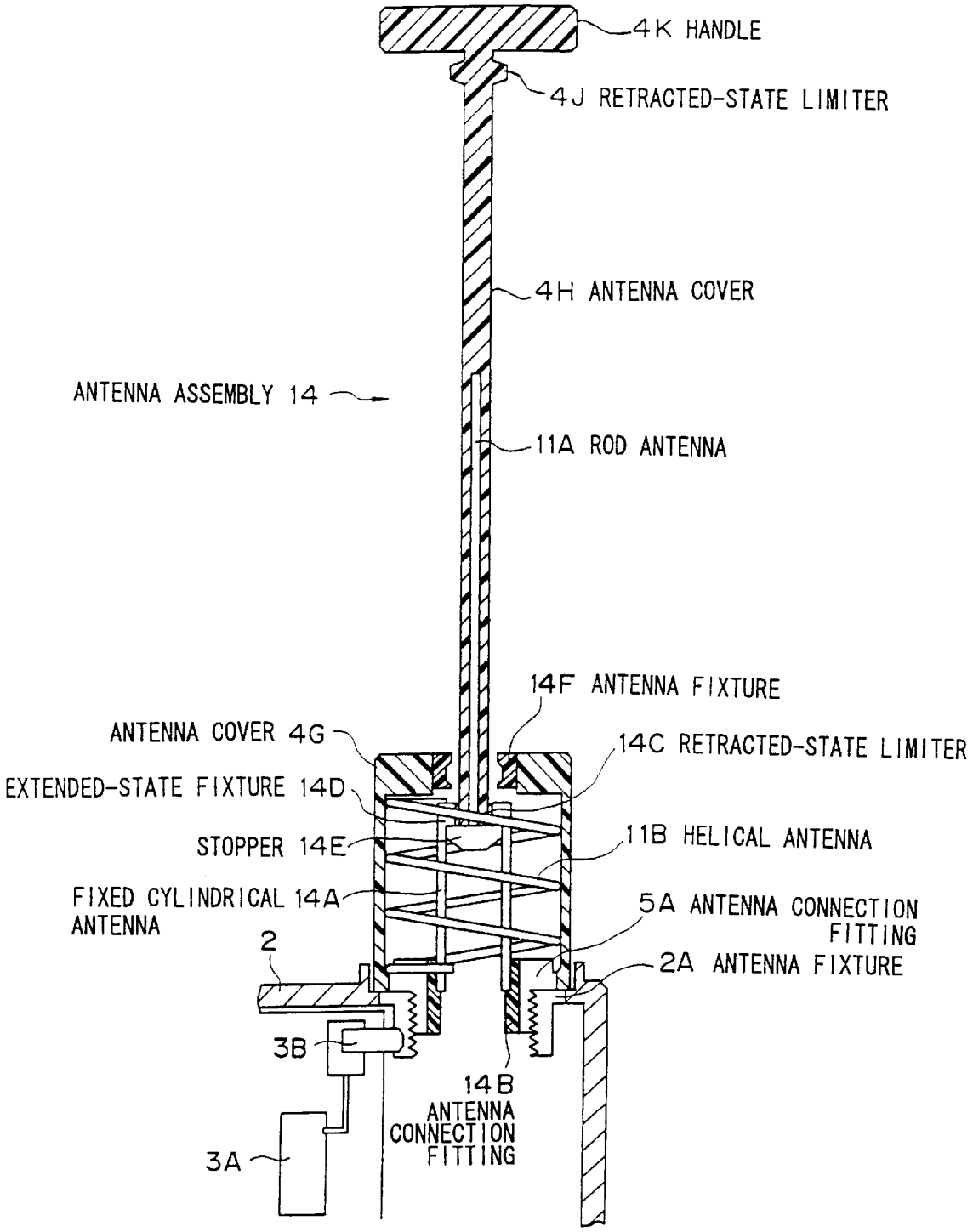
FIG. 13 is a cross-sectional view showing the connections of various portions when the antenna is used in the extended state in an antenna assembly according to a fourth embodiment of this invention.
Figure 14:
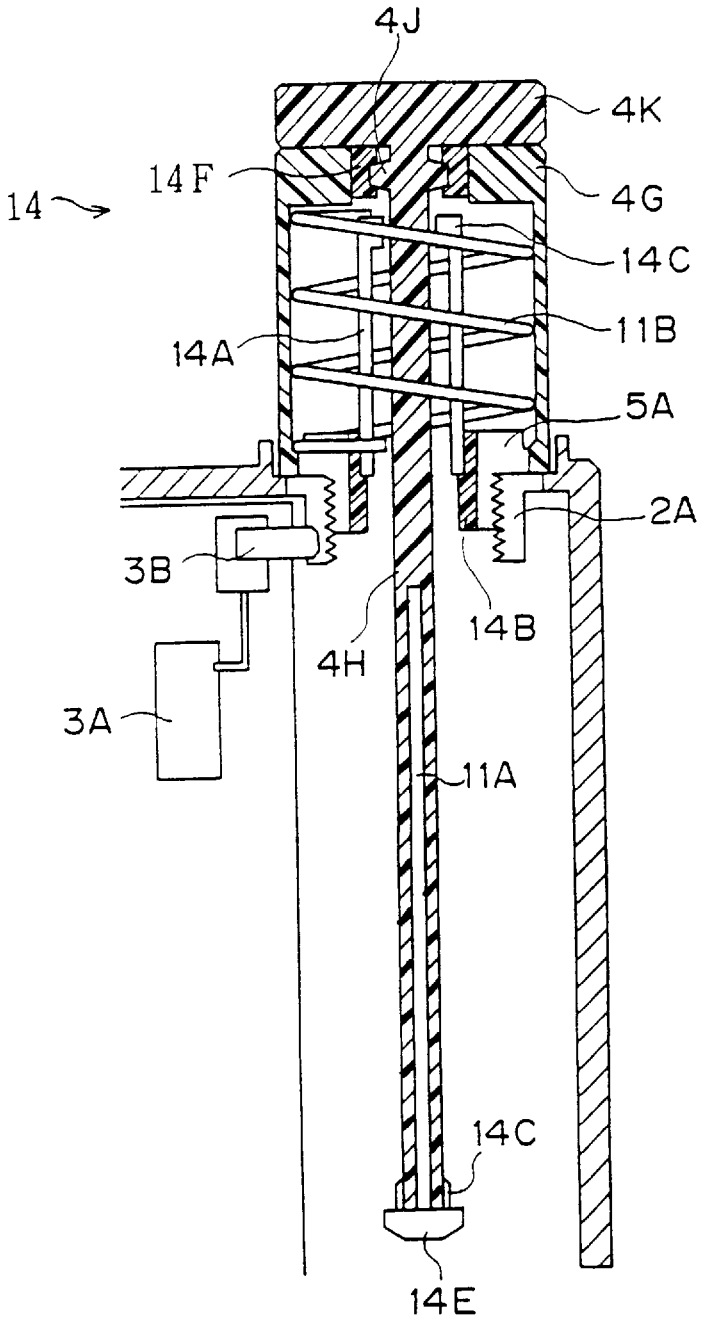
FIG. 14 is a cross-sectional view showing the connections of various portions when the antenna is used in the retracted state in the antenna assembly of FIG. 13.

In FIGS. 13 and 14, in which parts corresponding to those in FIGS. 7 and 8 are designated the same reference numerals, reference numeral 14 generally indicates an antenna assembly of this embodiment. The antenna assembly 14 basically differs from the antenna assembly 11, in terms of the structure, in that the former has a fixed cylindrical antenna 14A arranged inside a helical antenna 11B, and that a rod antenna 11A is mechanically and electrically connected to the top of the fixed cylindrical antenna 14A when it is extended.

An antenna fixture 14B for fixing the fixed cylindrical antenna 14A is made of a non-metallic material, and an antenna connection fitting 5A for securing the antenna fixture 14A is electrically isolated from the fixed cylindrical antenna 14A. In this embodiment, therefore, the fixed cylindrical antenna 14A is powered through electromagnetic coupling thereof with the helical antenna 11B.

With the foregoing structure, the operation of the antenna assembly 14 will be described for two cases: when the antenna assembly 14 is used with the rod antenna extended from a housing body 2 (extended state) and with the rod antenna left retracted in the housing body 2 (retracted state).

First, when the antenna assembly 14 is used in the extended state (FIG. 13), an extended-state limiter 14C arranged on a lower end portion of the rod antenna 11A is mechanically and electrically connected to an extended-state connection fitting 14D formed on the upper end of the fixed cylindrical antenna 14A.

In this state, the rod antenna 11A is electrically connected to the fixed cylindrical antenna 14A. Since the rod antenna 11A and the fixed cylindrical antenna 14A extend through the inside of the helical antenna 11B which is always connected to a power supply circuit 3A, they are excited by electromagnetic coupling between the helical antenna 11B and the fixed cylindrical antenna 14A, whereby they become operative as a linear antenna.

Stated another way, the rod antenna 11A and the fixed cylindrical antenna 14A are operative as a monopole antenna which has its ground level at the ground of a circuit board 3 and a shielding case. Incidentally, a stopper 14E is provided at the lower end of the rod antenna 11A for preventing the user from pulling out the antenna assembly 14.

On the other hand, when the antenna assembly 14 is used in the retracted state (FIG. 14), a retracted-state limiter 4J is mechanically engaged with an antenna fixture 14F in a secure manner. The rod antenna 11A, in turn, is separated from the fixed cylindrical antenna 14A and retracted in the housing body 2. In a fully retracted state, the upper end of the rod antenna 11A is located below the antenna connection fitting 5A.

The rod antenna 11A is thus electrically isolated from the fixed cylindrical antenna 14A. This causes the helical antenna 11B to operate as a helical antenna which has its ground level at the ground of the circuit board 3 and the shielding case.

As described above, the rod antenna 11A and the fixed cylindrical antenna 14A are operative as a monopole antenna when the rod antenna 11A is extended, while the helical antenna 11B is only operative as a single helical antenna when the rod antenna 11A is retracted. Consequently, favorable radiation can be realized in both cases when the antenna is extended and the antenna is retracted.

The foregoing structure according to the fourth embodiment can realize an antenna assembly and a portable radio apparatus which can reduce the length of an antenna housing space within the housing body 2 by the length of the fixed cylindrical antenna 14A which protrudes upward from the top surface of the housing body 2.

(5) Fifth Embodiment

Figure 15:
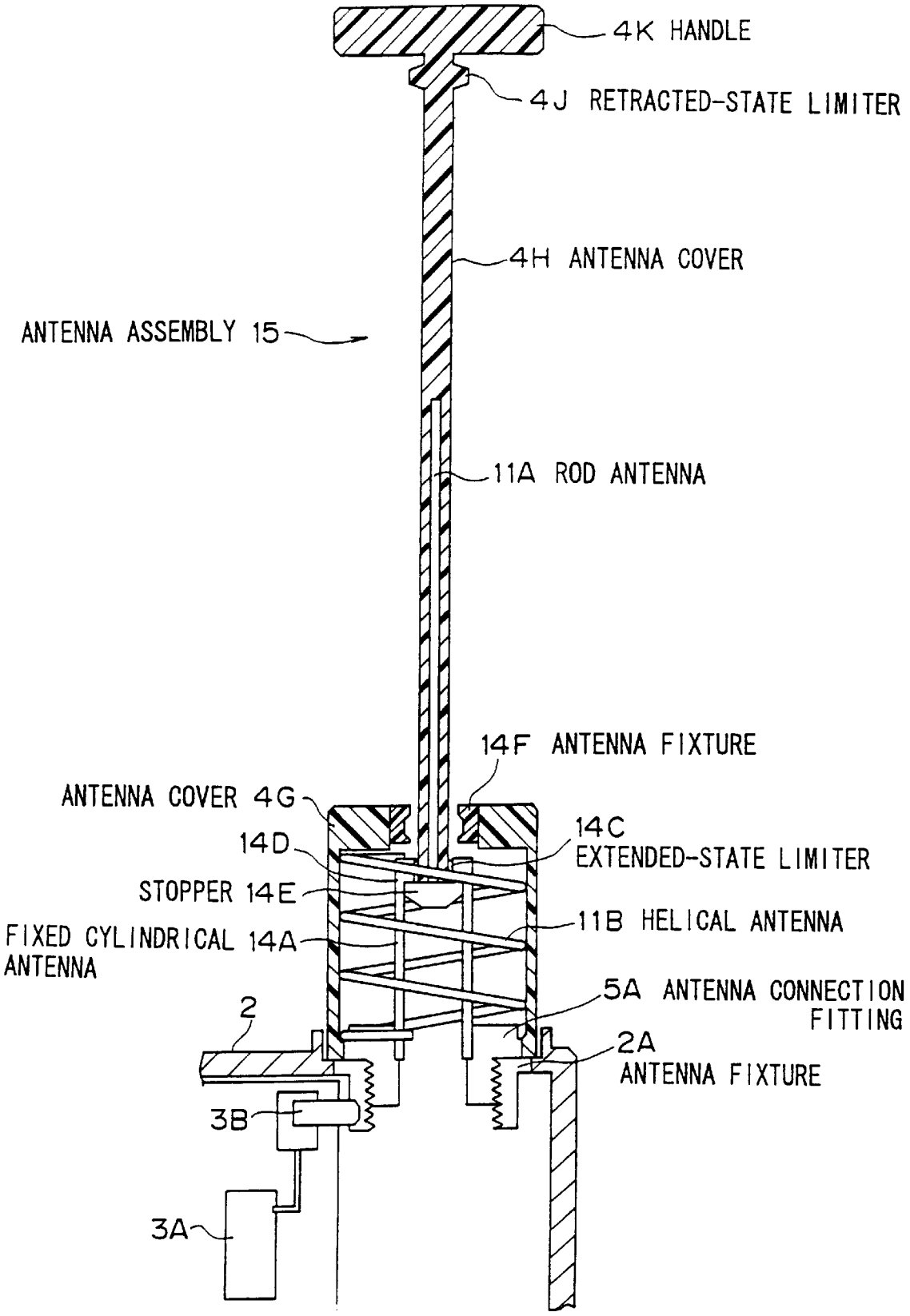
FIG. 15 is a cross-sectional view showing the connections of various portions when the antenna is used in the extended state in an antenna assembly according to a fifth embodiment of this invention.
Figure 16:
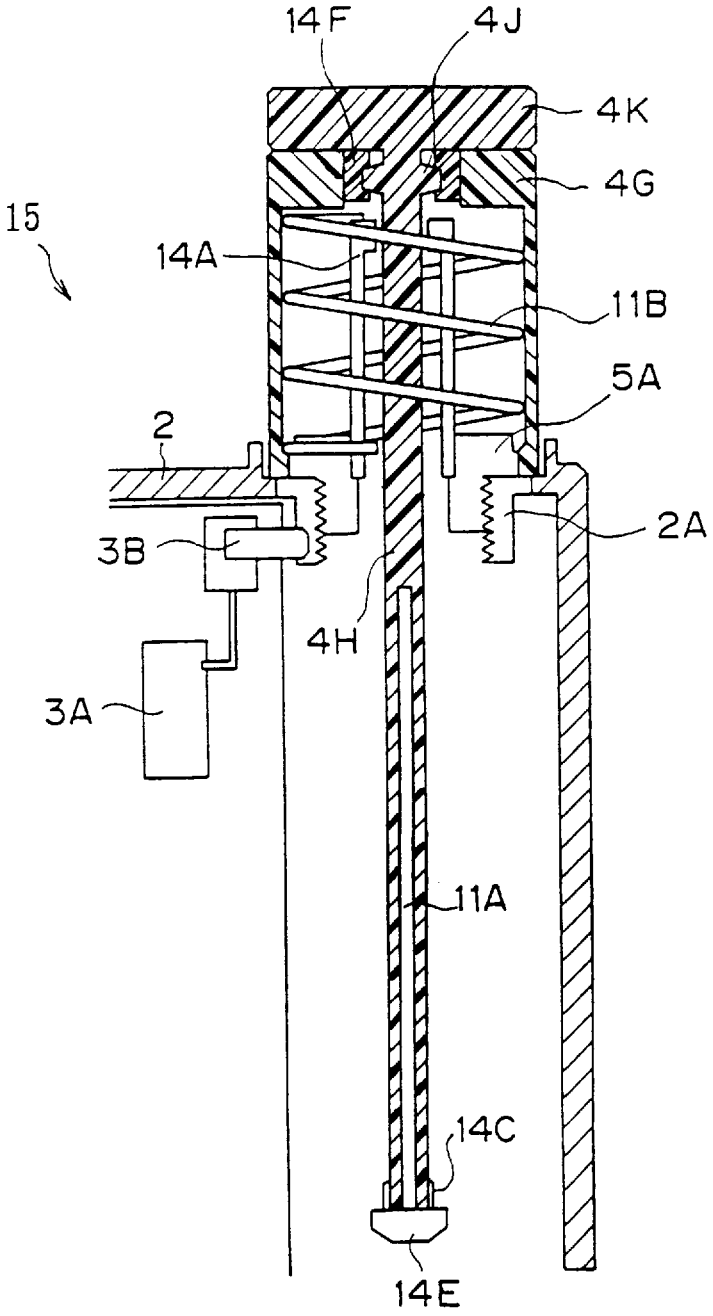
FIG. 16 is a cross-sectional view showing the connections of various portions when the antenna is used in the retracted state in the antenna assembly of FIG. 15.

In FIGS. 15 and 16, in which parts corresponding to those in FIGS. 13 and 14 are designated the same reference numerals, reference numeral 15 generally indicates an antenna assembly of this embodiment. The antenna assembly 15 has a similar structure to the antenna assembly 14 in FIG. 13, except that a fixed cylindrical antenna 14A is always supplied with electric power from a power supply circuit 3A. Stated another way, the antenna assembly 15 features that a lower end portion of the fixed cylindrical antenna 14A is mechanically and electrically connected to an antenna connection fitting 5A.

In this embodiment, a helical antenna 11B is operative mainly when a rod antenna 11A is retracted in a housing body 2 and as a supplement to a rod antenna 11A when it is extended. The rod antenna 11A, in turn, is operative only when it is extended.

With the foregoing structure, the operation of the antenna assembly 15 will be described for two cases: when the antenna assembly 15 is used with the rod antenna extended from a housing body 2 (extended state) and with the rod antenna left retracted in the housing body 2 (retracted state).

First, when the antenna assembly 15 is used in the extended state (FIG. 15), an extended-state limiter 14C arranged on a lower end portion of the rod antenna 11A is mechanically and electrically connected to an extended-state connection fitting 14D formed on the upper end of the fixed cylindrical antenna 14A.

In this state, the rod antenna 11A is electrically connected to the fixed cylindrical antenna 14A, so that they are brought into an operable state as a single linear antenna. In other words, the rod antenna 11A and the fixed cylindrical antenna 14A are operative as a monopole antenna which has its ground level at the ground of a circuit board 3 and a shielding case. Incidentally, a stopper 14E is provided at the lower end of the rod antenna 11A for preventing the user from pulling out the antenna assembly 15.

On the other hand, when the antenna assembly 15 is used in the retracted state (FIG. 16), a retracted-state limiter 4J is mechanically engaged with an antenna fixture 14F in a secure manner. The rod antenna 11A, in turn, is separated from the fixed cylindrical antenna 14A and retracted in the housing body 2. In a fully retracted state, the upper end of the rod antenna 11A is located below the antenna connection fitting 5A.

The rod antenna 11A is thus electrically isolated from the fixed cylindrical antenna 14A. This causes the helical antenna 11B to operate as a single helical antenna which has its ground level at the ground of the circuit board 3 and the shielding case.

As described above, the rod antenna 11A and the fixed cylindrical antenna 14A are operative as a monopole antenna when the rod antenna 11A is extended, while the helical antenna 11B is only operative as a single helical antenna when the rod antenna 11A is retracted. Consequently, favorable radiation can be realized in either of the two cases.

The foregoing structure can realize an antenna assembly and a portable radio apparatus which can reduce the length of an antenna housing space within the housing body by the length of the fixed cylindrical antenna 14A which protrudes upward from the top surface of the housing body 2.

(6) Sixth Embodiment

Figure 17:
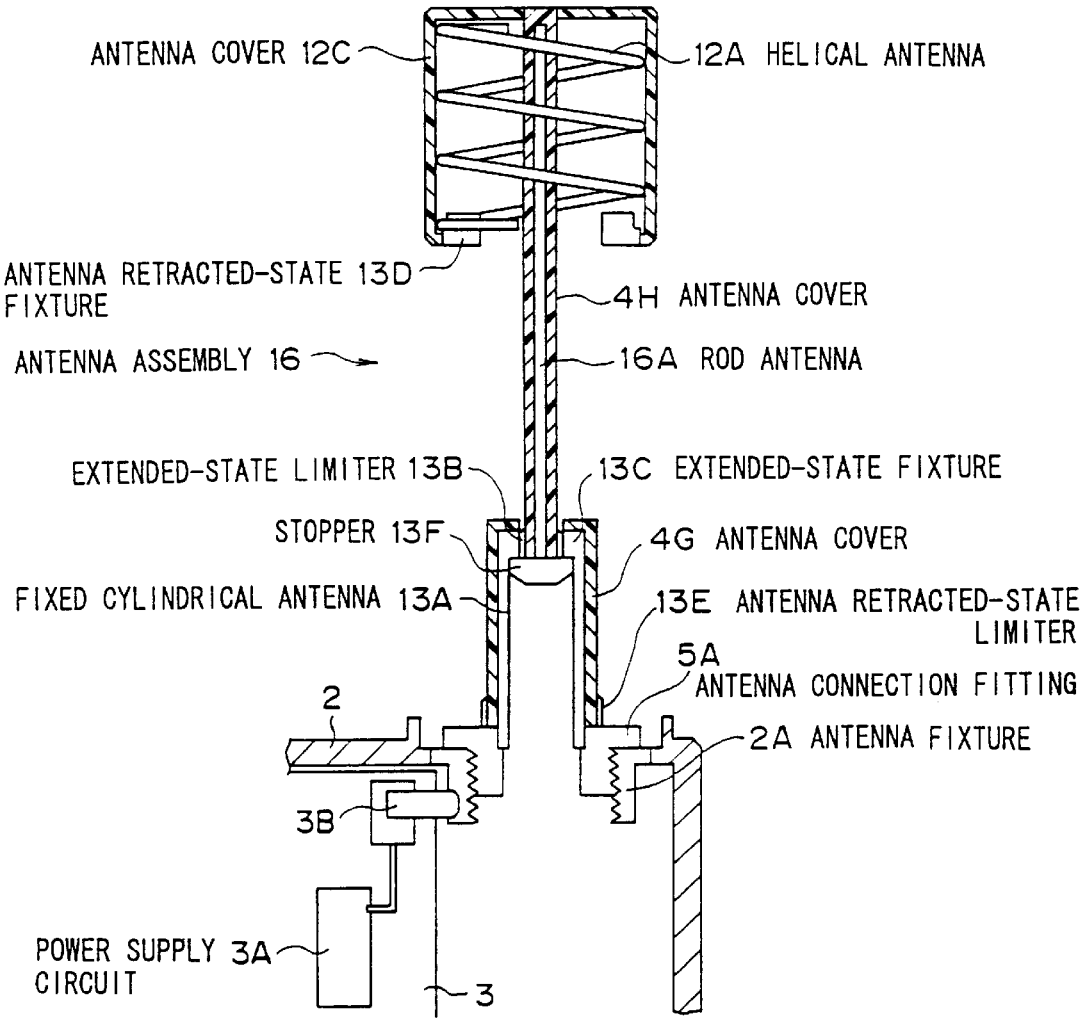
FIG. 17 is a cross-sectional view showing the connections of various portions when the antenna is used in the extended state in an antenna assembly according to a sixth embodiment of this invention.
Figure 18:
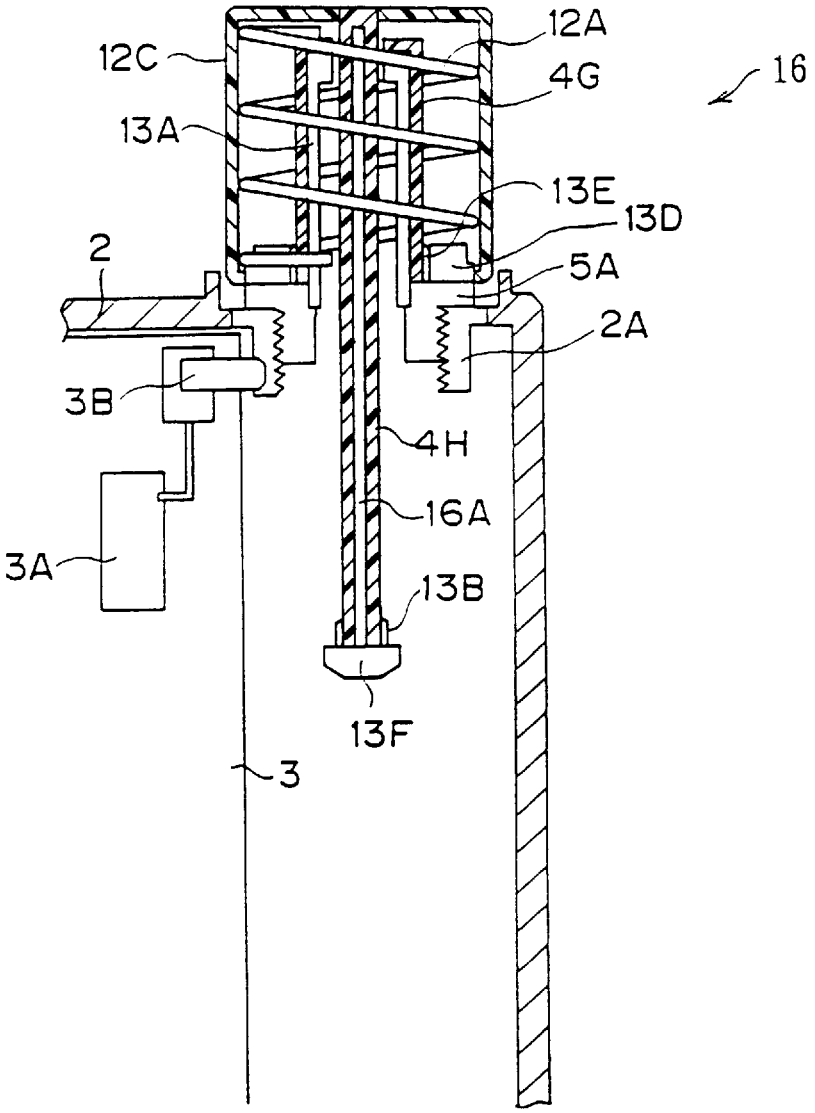
FIG. 18 is a cross-sectional view showing the connections of various portions when the antenna is used in the retracted state in the antenna assembly of FIG. 17.

In FIGS. 17 and 18, in which parts corresponding to those in FIGS. 11 and 12 are designated the same reference numerals, reference numeral 16 generally indicates an antenna assembly of this embodiment. The antenna assembly 16 has a similar structure to the antenna assembly 13 of FIG. 11, except that a rod antenna 16A extends through a helical antenna 12A, wherein the upper end of the rod antenna 16A is located at a height substantially equal to the top of the helical antenna 12A.

With the foregoing structure, the operation of the antenna assembly 16 will be described for two cases: when the antenna assembly 16 is used extended from a housing body 2 (extended state) and when it is used left retracted in the housing body 2 (retracted state).

First, when the antenna assembly 16 is used in the extended state (FIG. 17), an extended-state limiter 13B arranged on a lower end portion of the rod antenna 16A is mechanically and electrically connected to an extended-state connection fitting 13C formed on the upper end of a fixed cylindrical antenna 13A.

In this state, the rod antenna 16A is electrically integrally connected to the fixed cylindrical antenna 13A, so that they are operative as a linear antenna. Stated another way, the rod antenna 16A and the fixed cylindrical antenna 13A are operative as a monopole antenna which has its ground level at the ground of a circuit board 3 and a shielding case. Incidentally, a stopper 13F is provided at the lower end of the rod antenna 16A for preventing the user from pulling out the antenna assembly 16.

On the other hand, when the antenna assembly 16 is used in the retracted state (FIG. 18), an antenna retracted-state fixture 13D in an antenna cover 12C is mechanically and electrically connected to an antenna retracted-state limiter 13E, whereby the helical antenna 12A is electrically connected to a power supply circuit 3A. This allows the helical antenna 12A to operate as a helical antenna which has its ground level at the ground of the circuit board 3 and the shielding case.

As described above, the rod antenna 16A and the fixed cylindrical antenna 13A are operative as a monopole antenna when the antenna assembly 16 is extended, while the helical antenna 12A is only operative as a single helical antenna when the antenna assembly 16 is retracted. Consequently, favorable radiation can be realized in either of the two cases.

The foregoing structure can realize an antenna assembly and a portable radio apparatus which can reduce the length of an antenna housing space within the housing body 2 by the length of the fixed cylindrical antenna 13A which protrudes upward from the top surface of the housing body 2.

In addition, since the rod antenna 16A, in the retracted state, is placed inside the fixed cylindrical antenna 13A (inside the helical antenna 12A and within the housing body 2, an antenna housing space can be further reduced in the housing body 2, as compared with the third embodiment. Specifically, the length of the antenna housing space in the housing body 2 can be further reduced by the length of a rod antenna portion which protrudes from the upper end of an antenna fixture 2A (upper end of the housing body 2) into the fixed cylindrical antenna 13A.

(7) Seventh Embodiment

Figure 19:
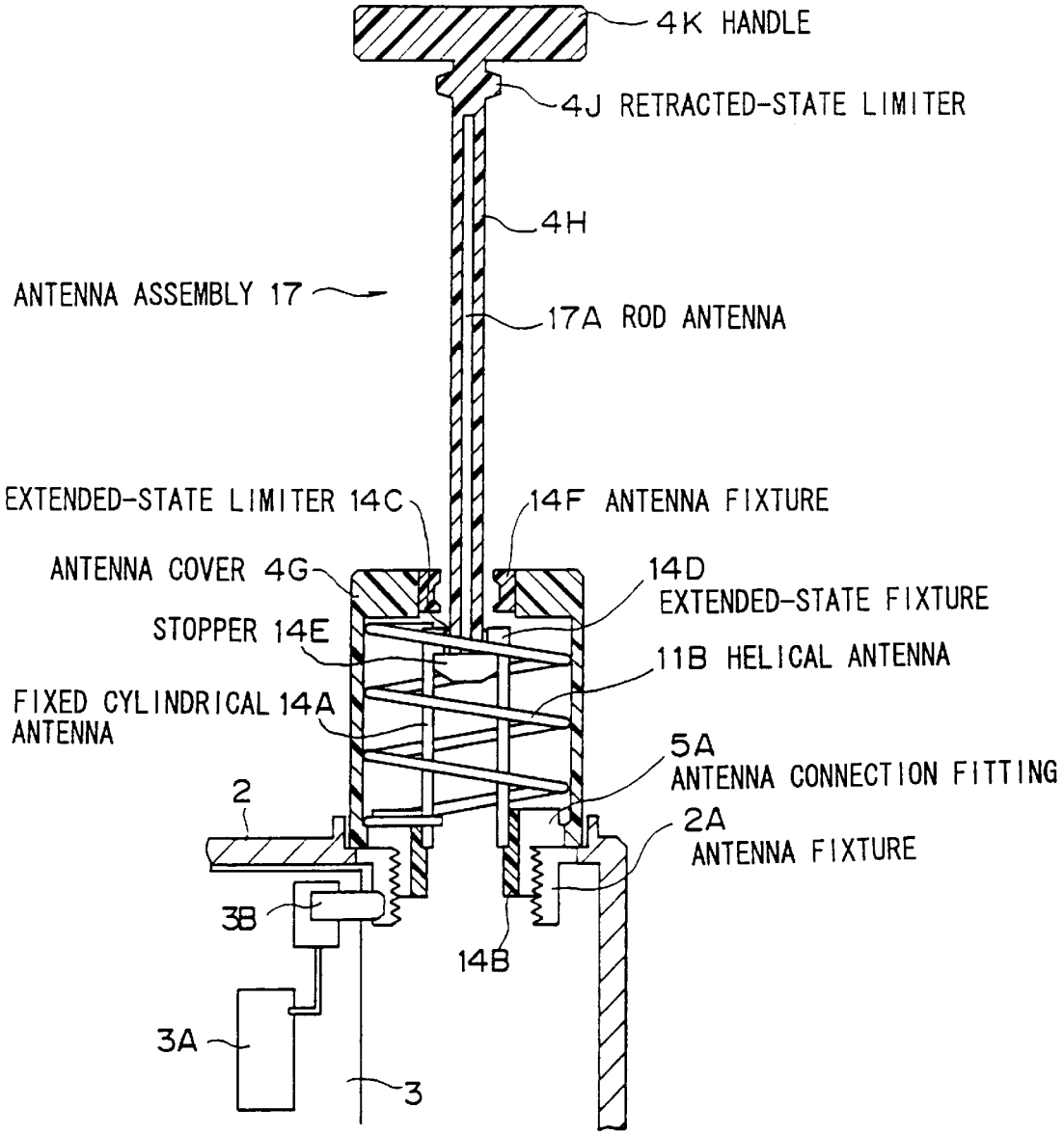
FIG. 19 is a cross-sectional view showing the connections of various portions when the antenna is used in the extended state in an antenna assembly according to a seventh embodiment of this invention.
Figure 20:
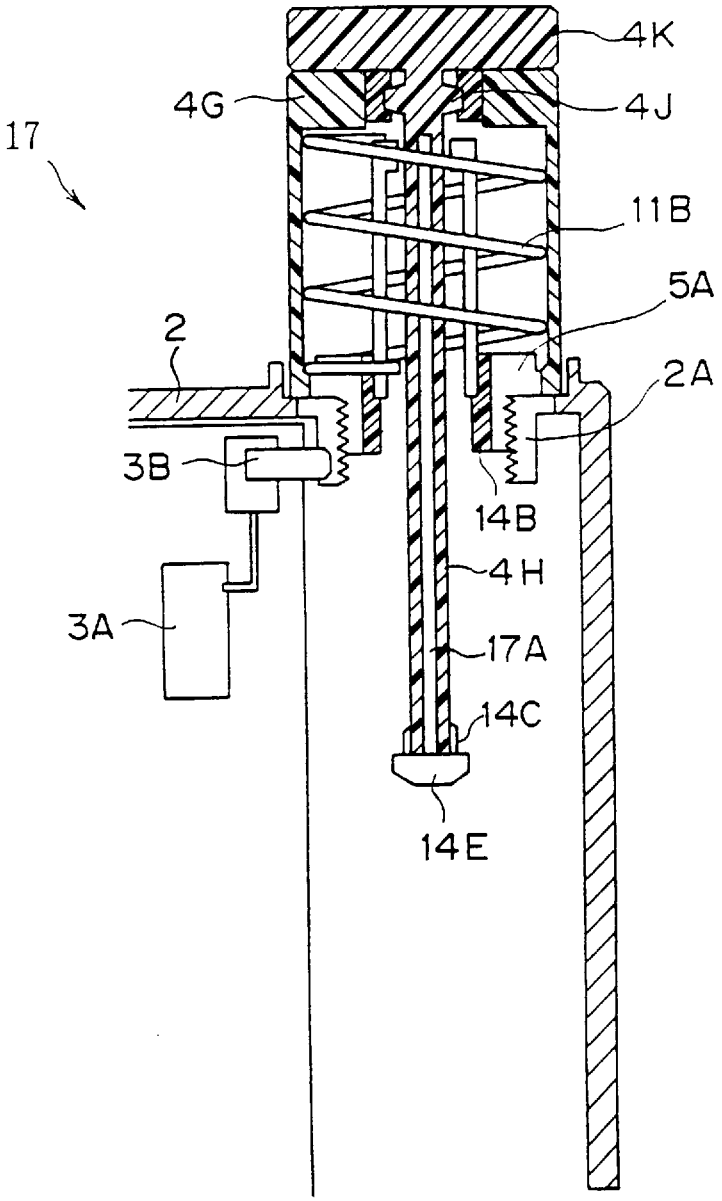
FIG. 20 is a cross-sectional view showing the connections of various portions when the antenna is used in the retracted state in the antenna assembly of FIG. 19.

In FIGS. 19 and 20, in which parts corresponding to those in FIGS. 7 and 8 are designated the same reference numerals, reference numeral 17 generally indicates an antenna assembly of this embodiment. The antenna assembly 17 has a similar structure as that of the antenna assembly 14 of FIG. 13, except that the upper end of a rod antenna 17A extends to the vicinity of a retracted-state limiter 4J. Stated another way, the rod antenna 17A, when retracted into a housing body 2, passes through the inside of a helical antenna 11B, and the upper end of the rod antenna 17A reaches near the top of the helical antenna 11B.

With the foregoing structure, the operation of the antenna assembly 17 will be described for two cases: when the antenna assembly 17 is used with the rod antenna 17A extended from a housing body 2 (extended state) and with the rod antenna 17A left retracted in the housing body 2 (retracted state).

First, when the antenna assembly 17 is used in the extended state (FIG. 19), an extended-state limiter 14C arranged on a lower end portion of the rod antenna 17A is mechanically and electrically connected to an extended-state connection fitting 14D formed on the upper end of a fixed cylindrical antenna 14A.

In this state, the rod antenna 17A is electrically connected to the fixed cylindrical antenna 14A so that they are operable as a single antenna. Since a base portion of the fixed cylindrical antenna 14A is fixed to an antenna connection fitting 5A through a non-metallic antenna fixture 14B, the fixed cylindrical antenna 14A is not directly powered from a power supply 3A. However, the fixed cylindrical antenna 14A extending through the inside of the helical antenna 11B causes electromagnetic coupling therebetween, whereby the fixed cylindrical antenna 14A is excited to enable the rod antenna 17A and the fixed cylindrical antenna 14A to operate as a linear antenna.

Stated another way, the rod antenna 17A and the fixed cylindrical antenna 14A are operative as a monopole antenna which has its ground level at the ground of a circuit board 3 and a shielding case. Incidentally, a stopper 14E is provided at the lower end of the rod antenna 17A for preventing the user from pulling out the antenna assembly 17.

On the other hand, when the antenna assembly 17 is used in the retracted state (FIG. 20), the retracted-state limiter 4J is mechanically engaged with an antenna fixture 14F formed in the top of an antenna cover 4G in a secure manner. This causes the helical antenna 11B to operate as a single helical antenna which has its ground level at the ground of the circuit board 3 and the shielding case.

As described above, the rod antenna 17A and the fixed cylindrical antenna 14A are operative as a monopole antenna when the rod antenna 17A is extended, whereas the helical antenna 11B is only operative as a single helical antenna when the rod antenna 17A is retracted. Consequently, the antenna assembly 17 can realize favorable radiation in either of the two cases.

The foregoing structure can realize an antenna assembly and a portable radio apparatus which can reduce the length of an antenna housing space within the housing body 2 by the length of the fixed cylindrical antenna 14A which protrudes upward from the top surface of the housing body 2.

In addition, since the rod antenna 17A, in the retracted state, is placed inside the fixed cylindrical antenna 14A (inside the helical antenna 11B) and within the housing body 2, an antenna assembly and a portable radio apparatus can be realized, in which an antenna housing space can be further reduced in the housing body 2, as compared with the third embodiment, by the length of a rod antenna portion which protrudes from the upper end of an antenna fixture 2A (upper end of the housing body 2) into the fixed cylindrical antenna 14A.

(8) Eighth Embodiment

Figure 21:
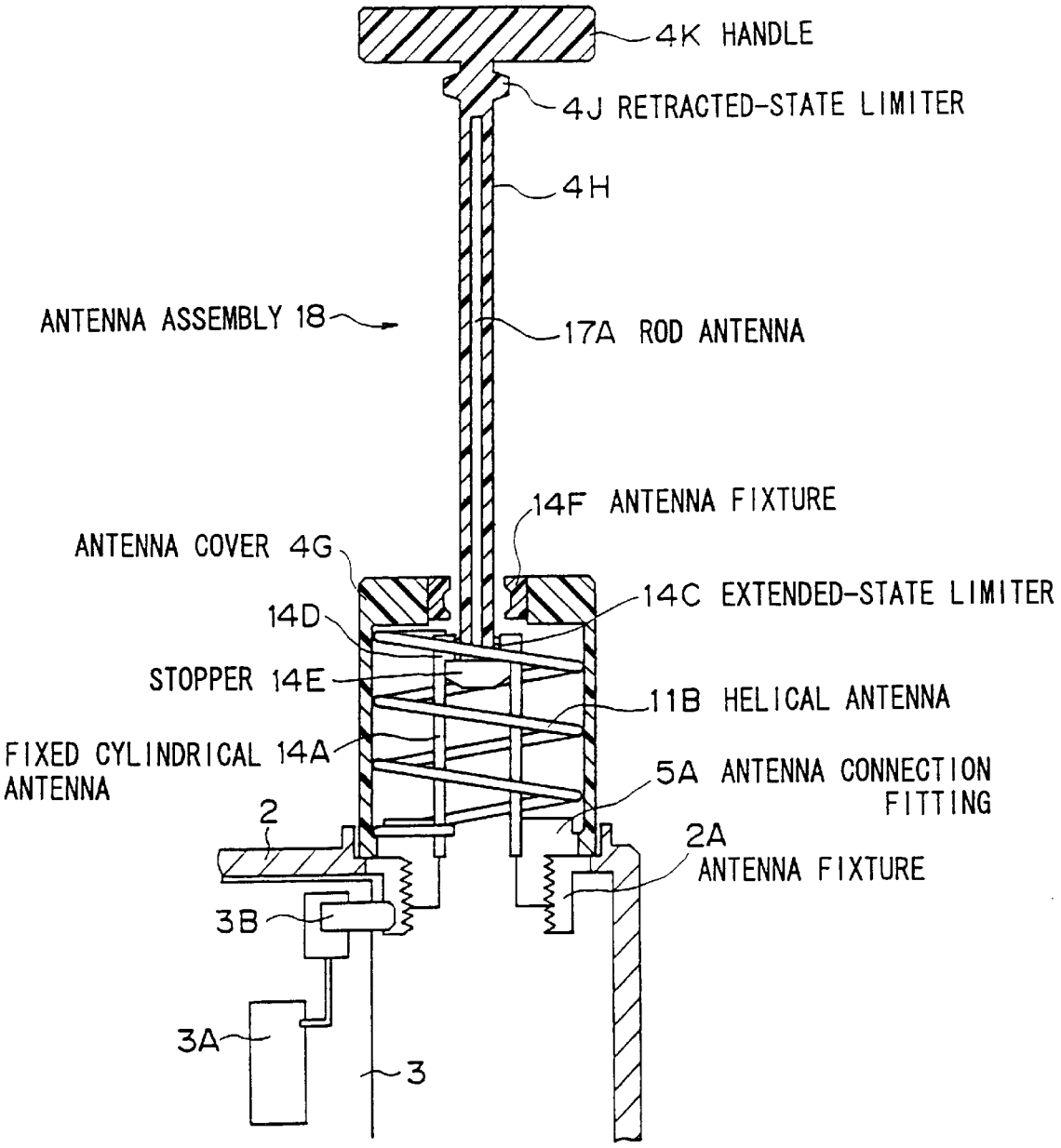
FIG. 21 is a cross-sectional view showing the connections of various portions when the antenna is used in the extended state in an antenna assembly according to an eighth embodiment of this invention.
Figure 22:
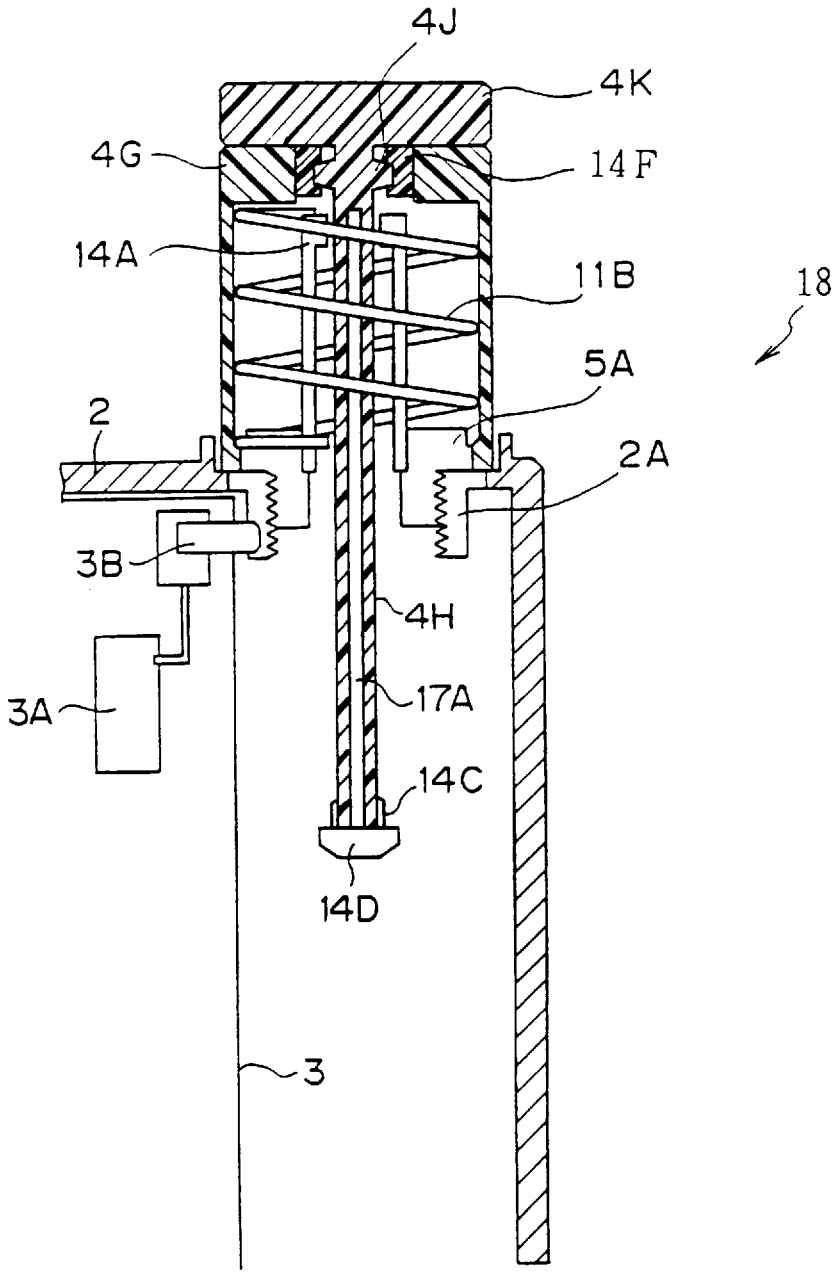
FIG. 22 is a cross-sectional view showing the connections of various portions when the antenna is used in the retracted state in the antenna assembly of FIG. 21.

In FIGS. 21 and 22, in which parts corresponding to those in FIGS. 19 and 20, reference numeral 18 generally indicates an antenna assembly of this embodiment. The antenna assembly 18 has a similar structure to the antenna assembly of FIG. 19, except that a fixed cylindrical antenna 14A is always powered from a power supply circuit 3A. Stated another way, the antenna assembly 18 features that the fixed cylindrical antenna 14A is mechanically and electrically connected at its lower portion to an antenna connection fitting 5A.

With the foregoing structure, the operation of the antenna assembly 18 will be described for two cases: when the antenna assembly 18 is used with the rod antenna 17A extended from a housing body 2 (extended state) and with the rod antenna 17A left retracted in the housing body 2 (retracted state).

First, when the antenna assembly 18 is used in the extended state (FIG. 21), an extended-state limiter 14C arranged on a lower end portion of the rod antenna 17A is mechanically and electrically connected to an extended-state connection fitting 14D formed on the upper end of a fixed cylindrical antenna 14A.

In this state, the rod antenna 17A is electrically connected to the fixed cylindrical antenna 14A. Since the fixed cylindrical antenna 14A is always connected to the power supply circuit 3A, the rod antenna 17A and the fixed cylindrical antenna 14A become operative as a linear antenna at the time the mechanical and electrical connection is established therebetween.

Stated another way, the rod antenna 17A and the fixed cylindrical antenna 14A are operative as a monopole antenna which has its ground level at the ground of a circuit board 3 and a shielding case. In this state, the helical antenna 11B is operative as a supplement to the monopole antenna. Also, a stopper 14E is provided at the lower end of the rod antenna 17A for preventing the user from pulling out the antenna assembly 17.

On the other hand, when the antenna assembly 17 is used in the retracted state (FIG. 22), the retracted-state limiter 4J is mechanically engaged with an antenna fixture 14F formed in the top of an antenna cover 4G in a secure manner. This causes the fixed cylindrical antenna 14A to electrically disconnect from the rod antenna 17A. Consequently, the helical antenna 11B becomes mainly operative as a single helical antenna which has its ground level at the ground of the circuit board 3 and the shielding case.

As described above, the rod antenna 17A and the fixed cylindrical antenna 14A are operative as a monopole antenna when the rod antenna 17A is extended, whereas the helical antenna 11B is mainly operative as a single helical antenna when the rod antenna 17A is retracted. Consequently, favorable radiation can be realized in both cases when the antenna is extended and the antenna is retracted.

The foregoing structure can realize an antenna assembly and a portable radio apparatus which can reduce the length of an antenna housing space within the housing body 2 by the length of the fixed cylindrical antenna 14A which protrudes upward from the top surface of the housing body 2.

In addition, since the rod antenna 17A, in the retracted state, is placed not only within the housing body 2 but also inside the fixed cylindrical antenna 14A (inside the helical antenna 11B), an antenna assembly and a portable radio apparatus can be realized, in which an antenna housing space can be further reduced in the housing body 2, as compared with the third embodiment, by the length of a rod antenna portion which protrudes from the upper end of an antenna fixture 2A (upper end of the housing body 2) into the fixed cylindrical antenna 14A.

(9) Ninth Embodiment

Figure 23:
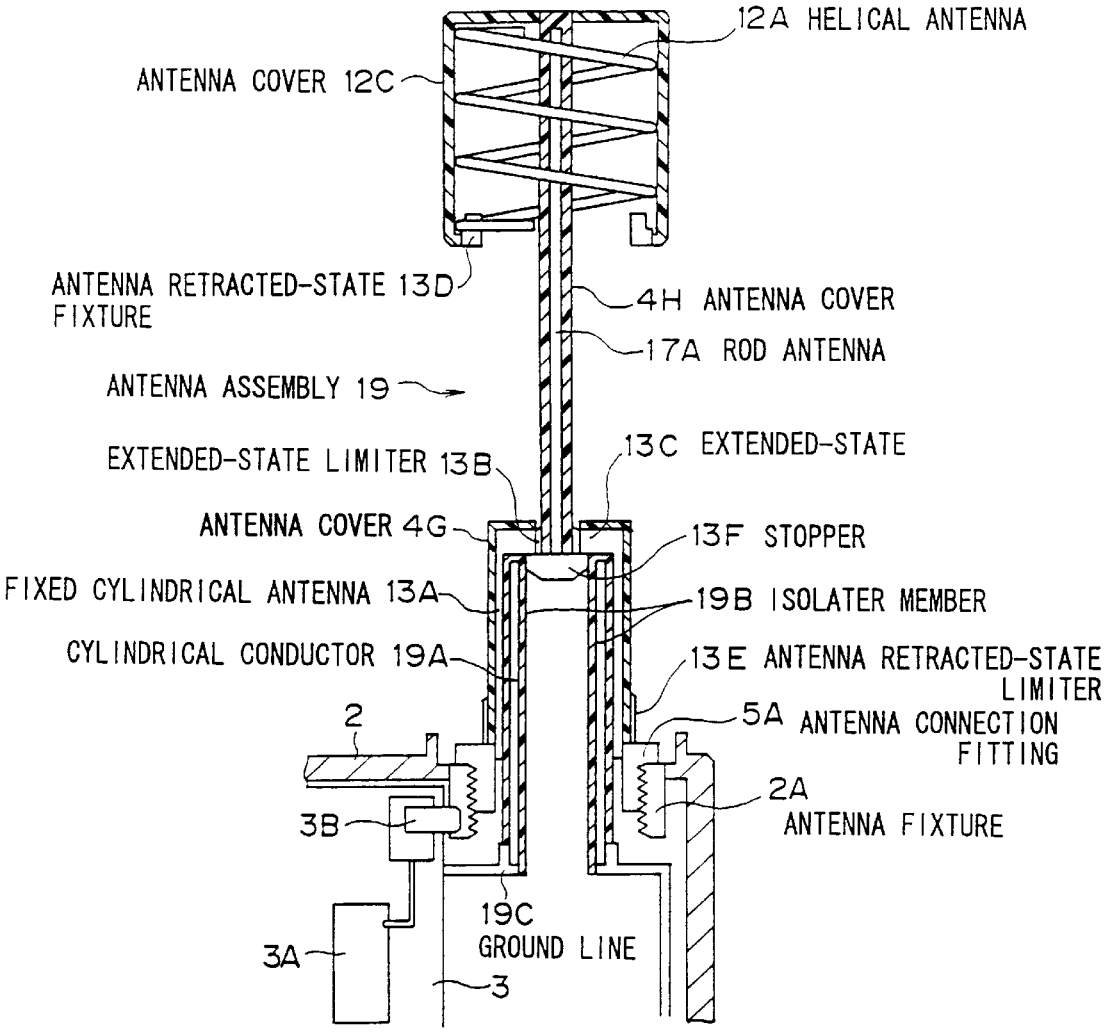
FIG. 23 is a cross-sectional view showing the connections of various portions when the antenna is used in the extended state in an antenna assembly according to a ninth embodiment of this invention.
Figure 24:
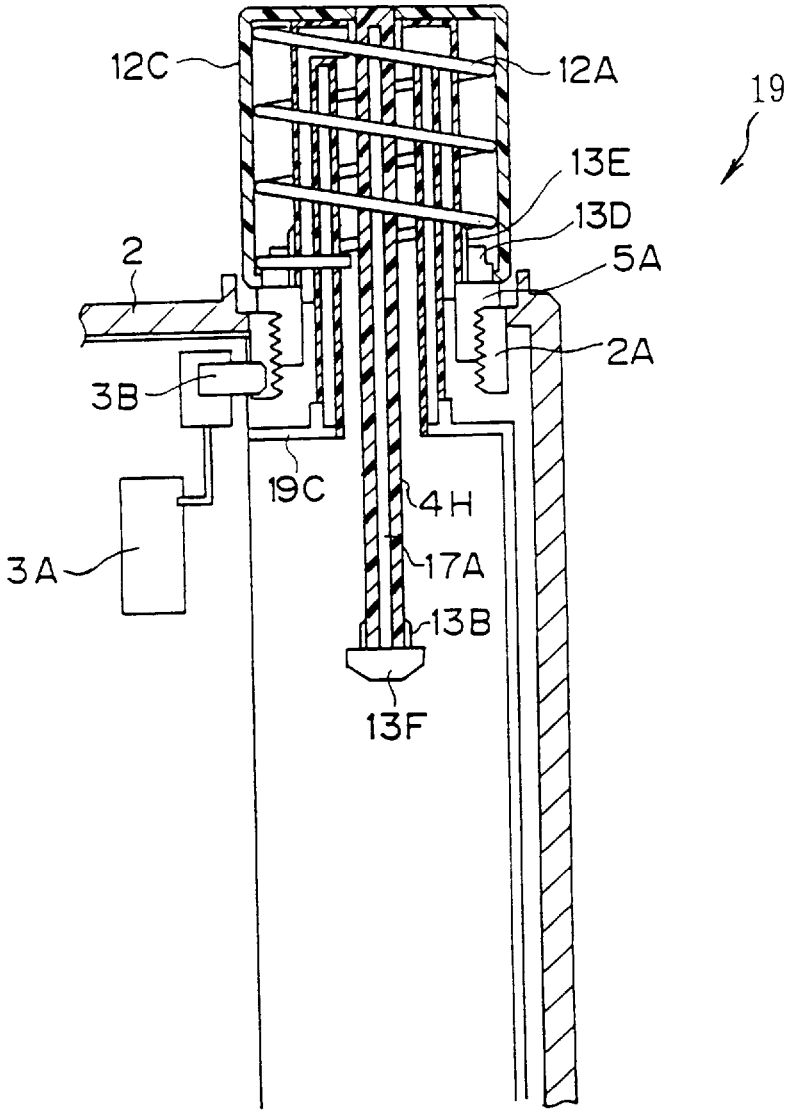
FIG. 24 is a cross-sectional view showing the connections of various portions when the antenna is used in the retracted state in the antenna assembly of FIG. 23.

In FIGS. 23 and 24, in which parts corresponding to those in FIGS. 17 and 18 are designated the same reference numerals, reference numeral 19 generally indicates an antenna assembly of this embodiment. The antenna assembly 19 has a similar structure to the antenna assembly 16 of FIG. 17, except that a cylindrical conductor 19A is additionally provided inside a fixed cylindrical antenna 13A. The fixed cylindrical antenna 13A and the cylindrical conductor 19A are electrically isolated from each other by a non-metallic isolator member 19B, and one end of the cylindrical conductor 19A is connected to a ground line 19C which leads to the ground of a circuit board 3.

With the foregoing structure, the operation of the antenna assembly 19 will be described for two cases: when the antenna assembly 19 is used extended from a housing body 2 (extended state) and when it is used left retracted in the housing body 2 (retracted state).

First, when the antenna assembly 19 is used in the extended state (FIG. 23), an extended-state limiter 13B arranged on a lower end portion of the rod antenna 17A is mechanically and electrically connected to an extended-state connection fitting 13C formed on the upper end of a fixed cylindrical antenna 13A.

In this state, the rod antenna 17A is electrically connected to the fixed cylindrical antenna 13A, so that they are operative as a linear antenna. Stated another way, the rod antenna 17A and the fixed cylindrical antenna 13A are operative as a monopole antenna which has its ground level at the ground of a circuit board 3 and a shielding case. Incidentally, a stopper 13F is provided at the lower end of the rod antenna 17A for preventing the user from pulling out the antenna assembly 19.

On the other hand, when the antenna assembly 19 is used in the retracted state (FIG. 24), an antenna retracted-state fixture 13D on an antenna cover 12C is mechanically and electrically connected to an antenna retracted-state limiter 13E, whereby the helical antenna 12A is electrically connected to a power supply circuit 3A. In this state, the rod antenna 17A is housed both inside the helical antenna 12A and within the housing body 2. However, since the grounded cylindrical conductor 19A is interposed between the helical antenna 12A and the rod antenna 17A, no electromagnetic coupling is produced.

Thus, in this embodiment, the helical antenna 12A only is brought into an operable state as a single helical antenna which has its ground level at the ground of the circuit board 3 and the shielding case.

As described above, the rod antenna 17A and the fixed cylindrical antenna 13A are operative as a monopole antenna when the rod antenna 17A is extended, while the helical antenna 12A is operative as a single helical antenna when the rod antenna 17A is retracted. Consequently, favorable radiation can be realized in both cases when the antenna is extended and the antenna is retracted.

The foregoing structure can realize an antenna assembly and a portable radio apparatus which can reduce the length of an antenna housing space within the housing body 2 by the length of the fixed cylindrical antenna 13A which protrudes upward from the top surface of the housing body 2.

In addition, since the rod antenna 17A, in the retracted state, is placed inside the fixed cylindrical antenna 13A (inside the helical antenna 12A) and within the housing body 2, an antenna housing space can be further reduced in the housing body 2, as compared with the third embodiment, by the length of a rod antenna portion which protrudes from the upper end of an antenna fixture 2A (upper end of the housing body 2) into the fixed cylindrical antenna 13A.

Further, in this embodiment, unnecessary radiation can be eliminated within the housing body 2, in the retracted state of the antenna assembly 19, by the capability of the cylindrical conductor 19A which electromagnetically isolates the helical antenna 12A from the rod antenna 17A.

(10) Tenth Embodiment

Figure 25:
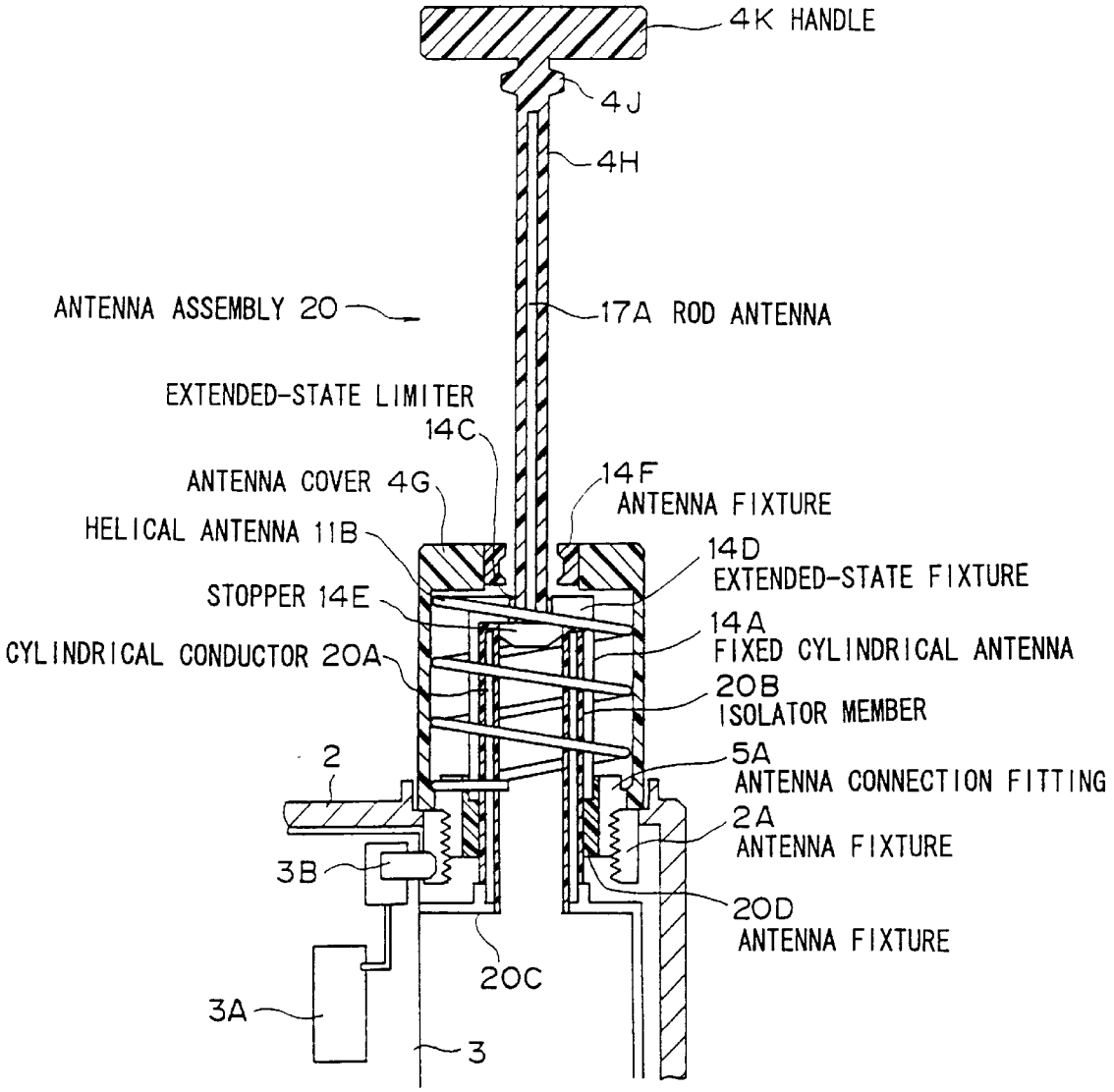
FIG. 25 is a cross-sectional view showing the connections of various portions when the antenna is used in the extended state in an antenna assembly according to a tenth embodiment of this invention.
Figure 26:
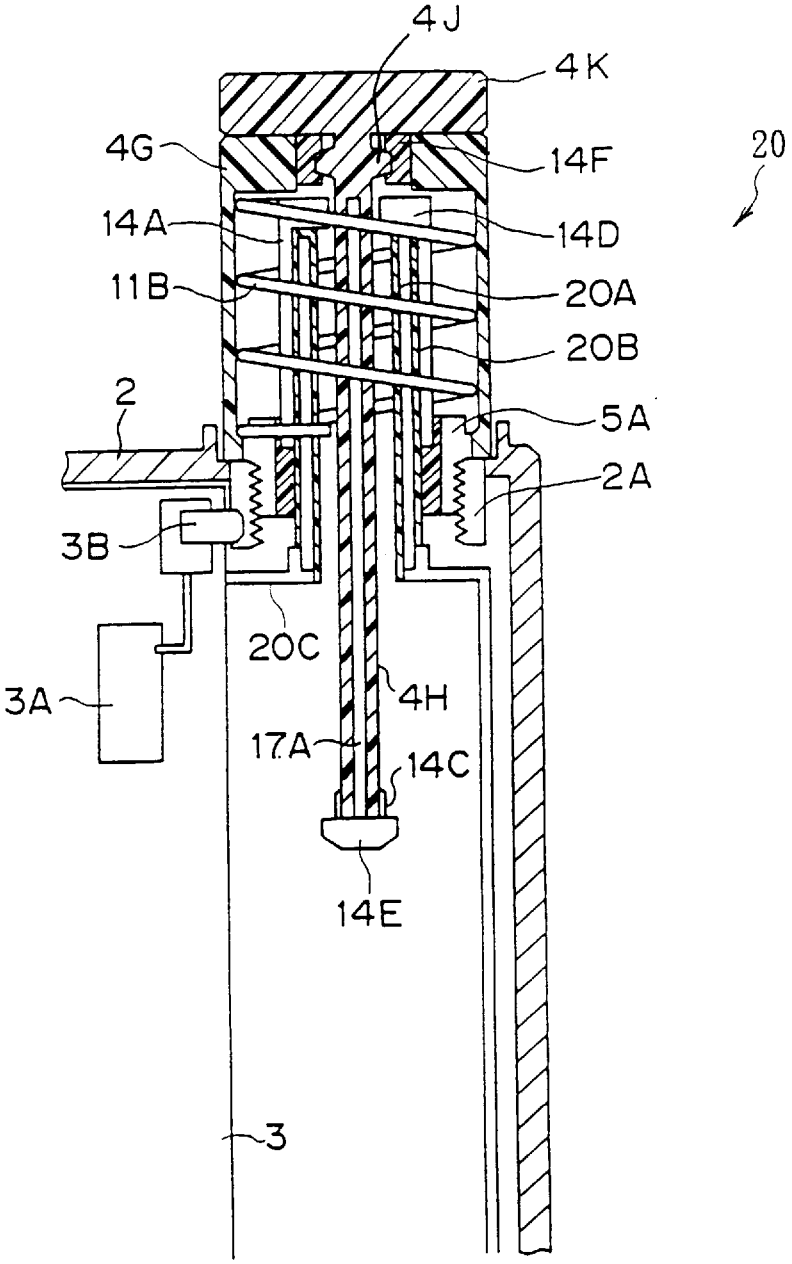
FIG. 26 is a cross-sectional view showing the connections of various portions when the antenna is used in the retracted state in the antenna assembly of FIG. 25.

In FIGS. 25 and 26, in which parts corresponding to those in FIGS. 19 and 20, reference numeral 20 generally indicates an antenna assembly of this embodiment. The antenna assembly 20 has a similar structure as that of the eighth embodiment shown in FIGS. 19 and 20 except that a cylindrical conductor 20A is additionally provided inside a fixed cylindrical antenna 14A.

It should be noted that in this embodiment, the cylindrical antenna 14A and the cylindrical conductor 20A are electrically isolated by a non-metallic isolator member 20B, and one end of the cylindrical conductor 20A is connected to a ground line 20C which extends from a circuit board 3.

Also, the fixed cylindrical antenna 14A is fixed to a non-metallic antenna fixture 20D so as not to be directly powered from a power supply circuit 3A.

With the foregoing structure, the operation of the antenna assembly 20 will be described for two cases: when the antenna assembly 20 is used with a rod antenna 17A extended from a housing body 2 (extended state) and with the rod antenna 17A left retracted in the housing body 2 (retracted state).

First, when the antenna assembly 20 is used in the extended state (FIG. 25), an extended-state limiter 14C arranged on a lower end portion of the rod antenna 17A is mechanically and electrically connected to an extended-state connection fitting 14D formed on the upper end of a fixed cylindrical antenna 14A.

In this state, the rod antenna 17A is electrically connected to the fixed cylindrical antenna 14A, so that they are brought into an operable state as an integral antenna. Since a base portion of the fixed cylindrical antenna 14A is fixed to an antenna connection fitting 5A through a non-metallic antenna fixture 20D, the fixed cylindrical antenna 14A is not directly powered from a power supply 3A. However, the fixed cylindrical antenna 14A extending through the inside of the helical antenna 11B causes electromagnetic coupling therebetween, whereby the fixed cylindrical antenna 14A is excited to enable the rod antenna 17A and the fixed cylindrical antenna 14A to operate as a linear antenna.

Stated another way, the rod antenna 17A and the fixed cylindrical antenna 14A are operative as a monopole antenna which has its ground level at the ground of the circuit board 3 and a shielding case. Incidentally, a stopper 14E is provided at the lower end of the rod antenna 17A for preventing the user from pulling out the antenna assembly 20.

On the other hand, when the antenna assembly 20 is used in the retracted state (FIG. 26), a retracted-state limiter 4J is mechanically engaged with an antenna fixture 14F formed in the top of an antenna cover 4G in a secure manner to define an antenna housing position.

In this state, the rod antenna 17A is housed inside the helical antenna 11B and within the housing body 2. However, no electromagnetic coupling is produced between the helical antenna 11B and the rod antenna 17A because of the existence of the cylindrical conductor 20A.

Thus, the helical antenna 11B becomes operative as a single helical antenna which has its ground level at the ground of the circuit board 3 and the shielding case without being affected by electromagnetic coupling.

As described above, the rod antenna 17A and the fixed cylindrical antenna 14A are operative as a monopole antenna when the rod antenna 17A is extended, while the helical antenna 11B is operative as a single helical antenna when the rod antenna 17A is retracted. Consequently, favorable radiation can be realized in either of the two cases.

The foregoing structure can realize an antenna assembly and a portable radio apparatus which can reduce the length of an antenna housing space within the housing body 2 by the length of the fixed cylindrical antenna 14A which protrudes upward from the top surface of the housing body 2.

In addition, since the rod antenna 17A, in the retracted state, is placed inside the fixed cylindrical antenna 14A (inside the helical antenna 11B) as well as within the housing body 2, an antenna assembly and a portable radio apparatus can be realized, in which an antenna housing space can be further reduced in the housing body 2, as compared with the third embodiment, by the length of a rod antenna portion which protrudes from the upper end of an antenna fixture 2A (upper end of the housing body 2) into the fixed cylindrical antenna 14A.

Further, unnecessary radiation can be eliminated within the housing body 2, in the retracted state of the antenna assembly 20, by the capability of the cylindrical conductor 20A which electromagnetically isolates the helical antenna 11B from the rod antenna 17A.

(11) Eleventh Embodiment

Figure 27:
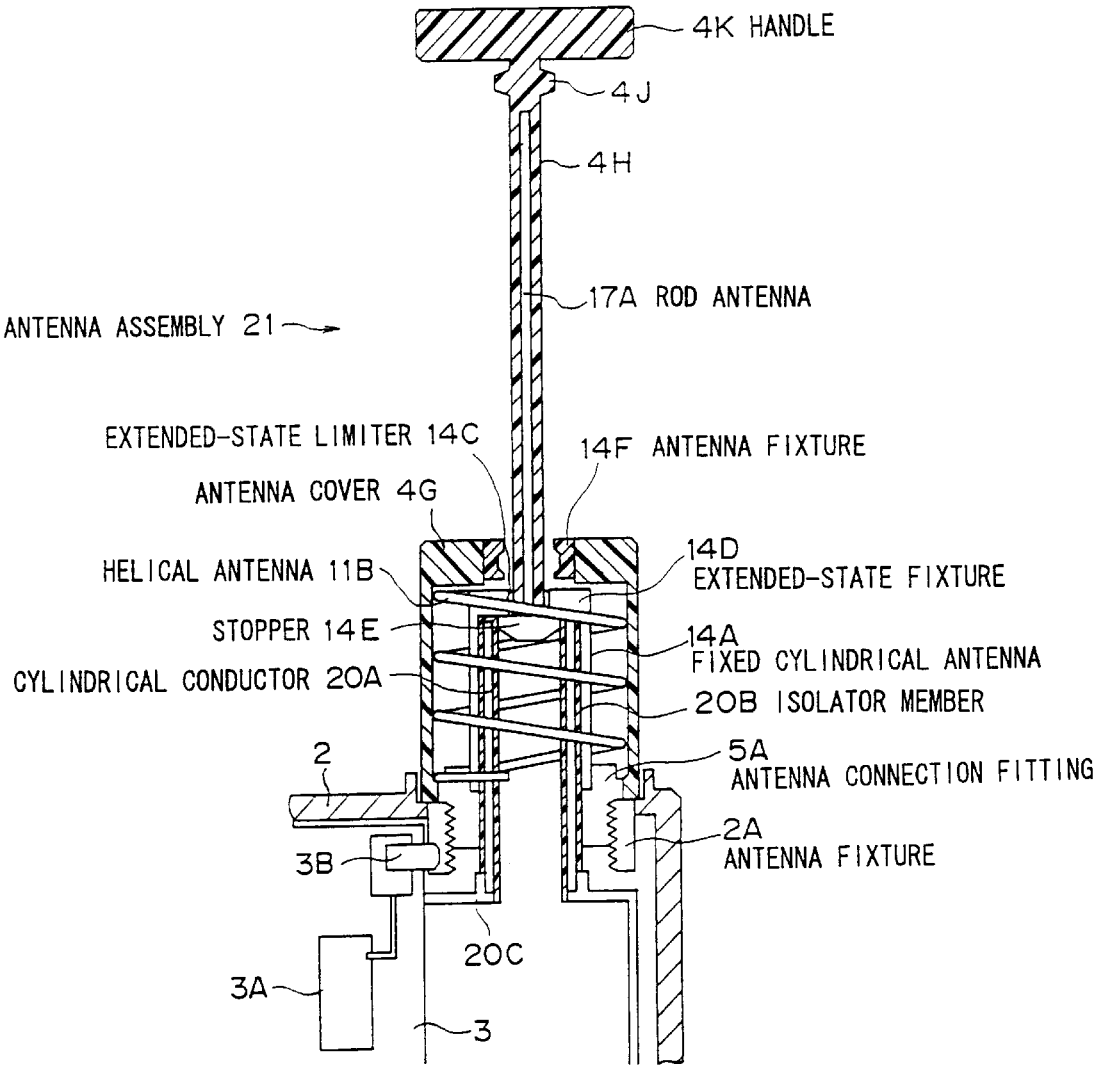
FIG. 27 is a cross-sectional view showing the connections of various portions when the antenna is used in the extended state in an antenna assembly according to an eleventh embodiment of this invention.
Figure 28:
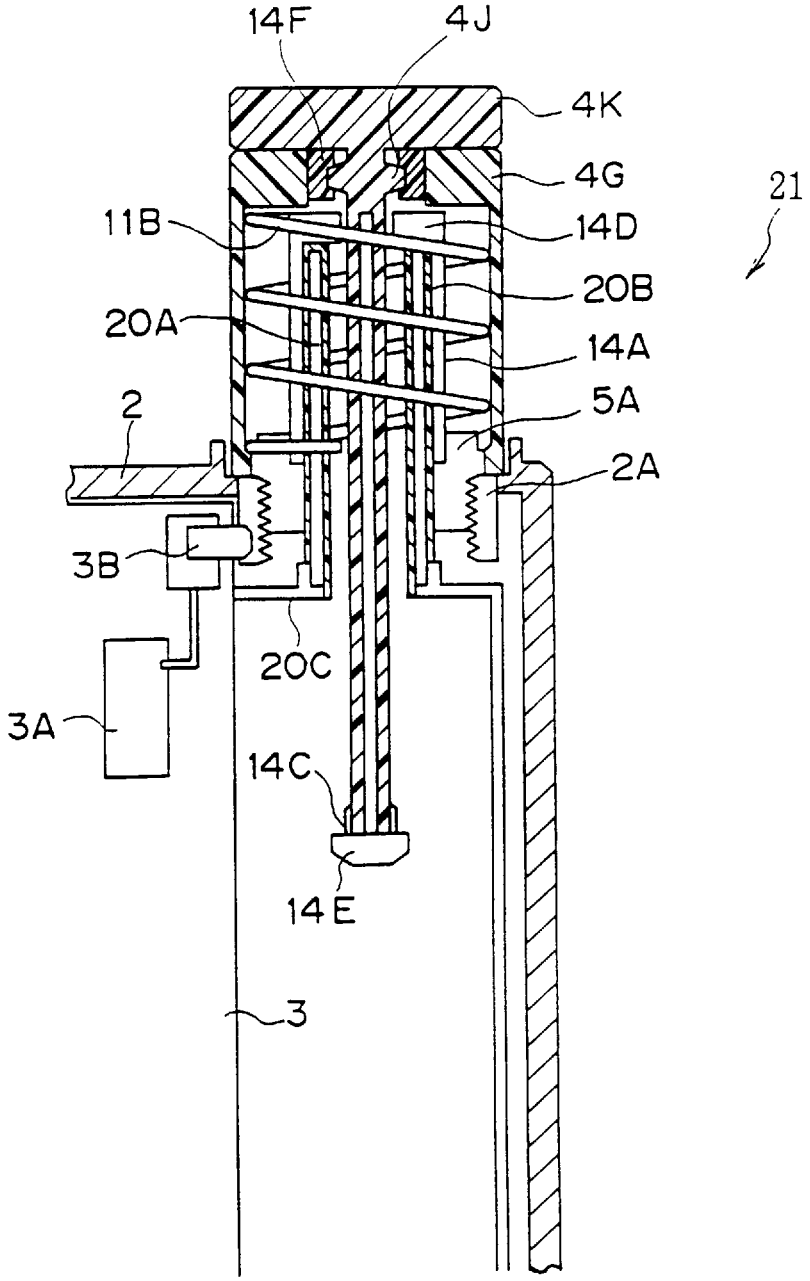
FIG. 28 is a cross-sectional view showing the connections of various portions when the antenna is used in the retracted state in the antenna assembly of FIG. 27.

In FIGS. 27 and 28, in which parts corresponding to those in FIGS. 25 and 26 are designated the same reference numerals, reference numeral 21 generally indicates an antenna assembly of this embodiment. The antenna assembly 21 has a similar structure to the antenna assembly 20 of FIG. 25, except that a fixed cylindrical antenna 14A is directly fixed to an antenna connection fitting 5A such that it is always powered from a power supply circuit 3A.

With the foregoing structure, the operation of the antenna assembly 21 will be described for two cases: when the antenna assembly 21 is used with the rod antenna 17A extended from a housing body 2 (extended state) and with the rod antenna 17A left retracted in the housing body 2 (retracted state).

First, when the antenna assembly 21 is used in the extended state (FIG. 27), an extended-state limiter 14C arranged on a lower end portion of the rod antenna 17A is mechanically and electrically connected to an extended-state connection fitting 14D formed on the upper end of a fixed cylindrical antenna 14A.

In this state, the rod antenna 17A is electrically connected to the fixed cylindrical antenna 14A, so that they are brought into an operable state as an integral antenna. Since a base portion of the fixed cylindrical antenna 14A is electrically and mechanically connected to an antenna connection fitting 5A in a secure manner, the rod antenna 17A and the fixed cylindrical antenna 14A are operative as a linear antenna which is directly powered from the power supply circuit 3A.

Stated another way, the rod antenna 17A and the fixed cylindrical antenna 14A are operative as a monopole antenna which has its ground level at the ground of the circuit board 3 and a shielding case. Incidentally, a stopper 14E is provided at the lower end of the rod antenna 17A for preventing the user from pulling out the antenna assembly 21.

On the other hand, when the antenna assembly 21 is used in the retracted state (FIG. 28), a retracted-state limiter 4J is mechanically engaged with an antenna fixture 14F formed in the top of an antenna cover 4G in a secure manner to define an antenna housing position.

In this state, the rod antenna 17A is housed inside the helical antenna 11B and within the housing body 2. However, no electromagnetic coupling is produced between the helical antenna 11B and the rod antenna 17A because of the existence of the cylindrical conductor 20A which is electrically connected to a ground line 20C.

Thus, the helical antenna 11B is only operative as a single helical antenna which has its ground level at the ground of the circuit board 3 and the shielding case.

As described above, the rod antenna 17A and the fixed cylindrical antenna 14A are operative as a monopole antenna when the rod antenna 17A is extended, while the helical antenna 11B is operative as a single helical antenna when the rod antenna 17A is retracted. Consequently, favorable radiation can be realized in either of the two cases.

The foregoing structure can realize an antenna assembly and a portable radio apparatus which can reduce the length of an antenna housing space within the housing body by the length of the fixed cylindrical antenna 14A which protrudes upward from the top surface of the housing body 2.

In addition, since the rod antenna 17A, in the retracted state, is placed inside the fixed cylindrical antenna 14A (inside the helical antenna 11B) as well as within the housing body 2, an antenna assembly and a portable radio apparatus can be realized, in which an antenna housing space can be further reduced in the housing body 2, as compared with the third embodiment, by the length of a rod antenna portion which protrudes from the upper end of an antenna fixture 2A (upper end of the housing body 2) into the fixed cylindrical antenna 14A.

Further, unnecessary radiation can be eliminated within the housing body 2, in the retracted state of the antenna assembly 21, by the capability of the cylindrical conductor 20A which electromagnetically isolates the helical antenna 11B from the rod antenna 17A.

(12) Twelfth Embodiment

Figure 29:
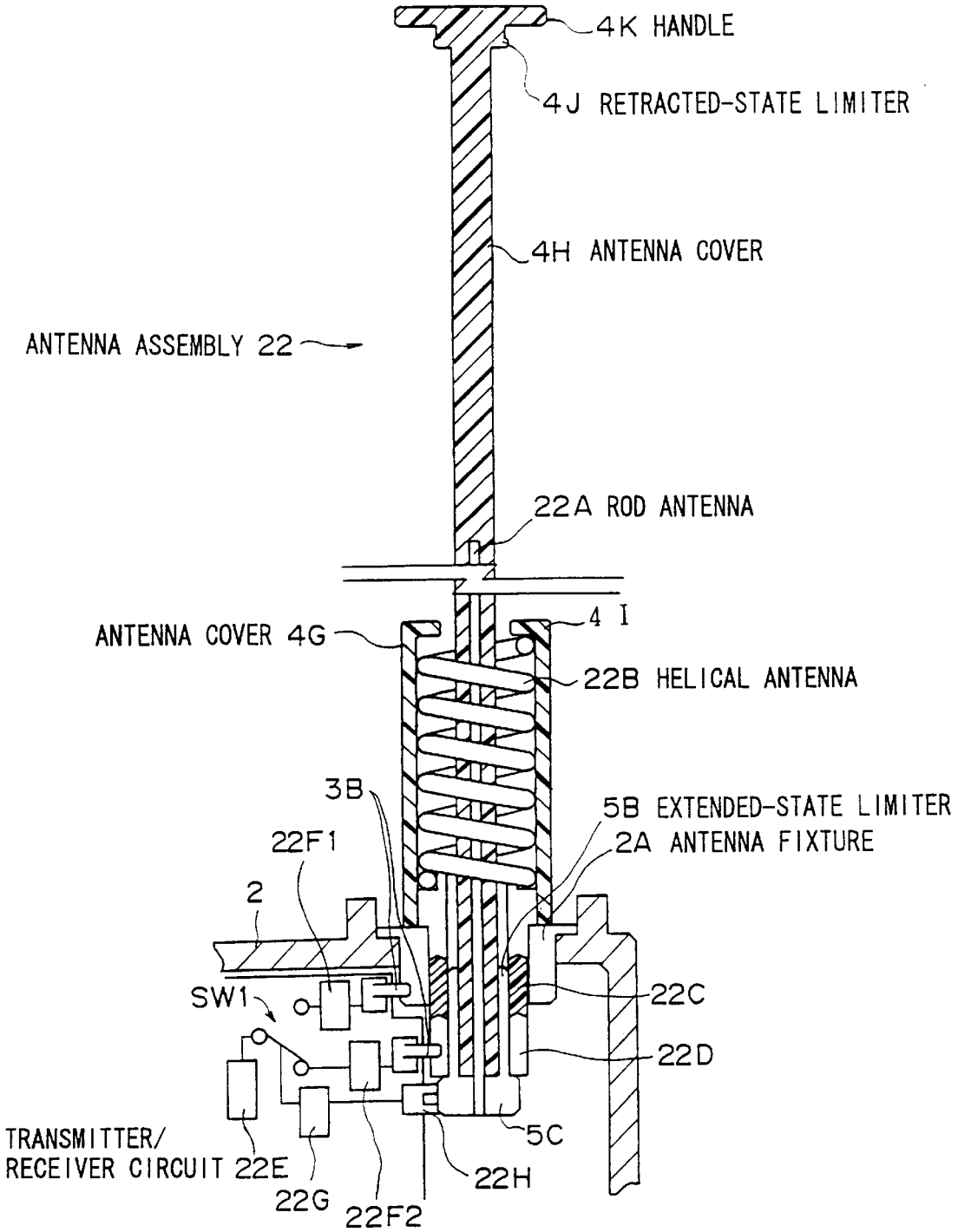
FIG. 29 is a cross-sectional view showing the connections of various portions when the antenna is used in the extended state in an antenna assembly according to a twelfth embodiment of this invention.
Figure 30:
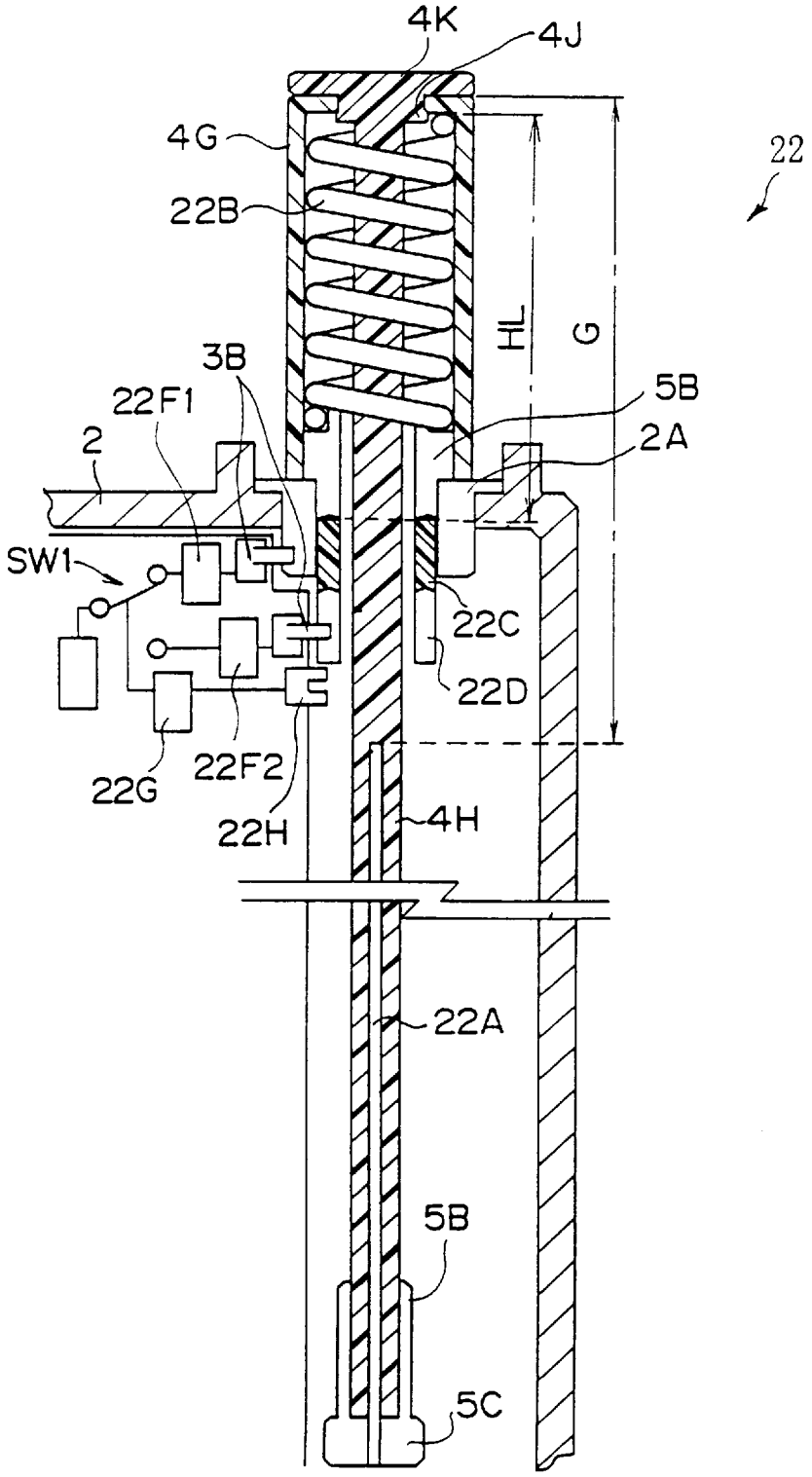
FIG. 30 is a cross-sectional view showing the connections of various portions when the antenna is used in the retracted state in the antenna assembly of FIG. 29.

In FIGS. 29 and 30, in which parts corresponding to those in FIGS. 15 and 16 are designated the same reference numerals, reference numeral 22 generally indicates an antenna assembly of this embodiment. The antenna assembly 22 features that it has two kinds of antennas, i.e., a rod antenna 22A and a helical antenna 22B for which two power supply lines are provided.

Explanation will be first given of how to attach the respective antennas to a housing body 2 and of the mutual positional relationship between the two antennas. The rod antenna 22A extends upward through the inside of the helical antenna 22B. The rod antenna 22A is connected to the housing body 2 through an extended-state limiter 5B, wherein the antenna assembly 22 differs from conventional ones in the structure for joining the extended-state limiter 5B with the antenna fixture 2A.

More specifically, the extended-state limiter 5B is fixed by mechanical contact of a spacer 22C interposed between the extended-state limiter 5B and an antenna fixture 2A with an antenna support member 22D. In this structure, the spacer 22C, which is the only member in contact with the antenna fixture 2A, is made of a non-metallic material, such that no power supply line is formed between the antenna fixture 2A and the rod antenna 22A.

Thus, electrically connected to the antenna fixture 2A is only the helical antenna 22B, so that the helical antenna 22B can only be powered through the antenna fixture 2A.

On the other hand, since the antenna support member 22D is electrically connected only to the rod antenna 22A, the rod antenna 22A can only be powered by powering the antenna support member 22D.

The antenna fixture 2A is powered from a transmitter/receiver circuit 22E through a switch SW1, matching circuit 22F1, and power supply spring 3B in that order. The antenna support member 22D, in turn, is powered from the transmitter/receiver circuit 22E through the switch SW1, matching circuit 22F2, and power supply spring 3B in that order. Thus, the power supply can be alternately switched to the antenna fixture 2A or the antenna support member 22D depending on which of the power supply lines the switch SW1 is positioned.

The switch SW1 may be driven by a determining circuit 22G which receives a sense signal from a sensor 22H having a mechanical or electrical organization and determines to which power supply line the switch SW1 is changed over based on the sense signal. More specifically, the determining circuit 22G changes over the switch SW1 to a contact for powering the antenna support member 22D when the rod antenna 22A is fully extended, and to the other contact for powering the antenna fixture 2A when the rod antenna 22A is retracted in the housing body 2 or when it is not fully extended from the housing body 2.

The respective matching circuits 22F1 and 22F2 can be individually adjusted such that the switching of the power supply lines does not result in different input impedance.

Also, the sensor 22H is located near a position at which the stopper 5C for the rod antenna 22A should exist when the rod antenna 22A is fully extended so as to ensure that it detect the position of the stopper 5C.

With the foregoing structure, the operation of the antenna assembly 22 will be described for two cases: when the antenna assembly 22 is used with the rod antenna 22A extended from a housing body 2 (extended state) and with the rod antenna 22A left retracted in the housing body 2 (retracted state).

First, when the antenna assembly 22 is used in the extended state (FIG. 29), at the time the sensor 22H confirms fully extension of the rod antenna 22A, the determining circuit 22G is supplied with a sense signal from the sensor 22H and responsively changes over the switch SW1 to the matching circuit 22F2.

In this way, an RF signal from the transmitter/receiver circuit 22E is supplied to the antenna support member 22D through the matching circuit 22F2 and the power supply spring 3B. In this event, the rod antenna 22A is excited through the extended-state limiter 5B which is mechanically and electrically connected to the antenna support member 22D.

It should be noted that the helical antenna 22B, which is electrically isolated completely from the rod antenna 22A, will not operate as an antenna.

The rod antenna 22A is thus operative as a monopole antenna which has its ground level at the ground of a circuit board 3 and a shielding case. Incidentally, the stopper 5C is provided at the lower end of the rod antenna 22A for preventing the user from pulling out the antenna assembly 22.

On the other hand, when the antenna assembly 22 is used in the retracted state (FIG. 30), a retracted-state limiter 4J is mechanically engaged with an antenna fixture 4I formed in the top of an antenna cover 4G in a secure manner to define an antenna housing position.

When the rod antenna 22A is pushed into the housing body 2 and fully retracted therein, the determining circuit 22G detects this state based on a sense signal from the sensor 22H and changes over the switch SW1 to supply an RF signal to the helical antenna 22B in this case.

In this state, since the rod antenna 22A is fully retracted such that its upper end is located below the antenna support member 22D, no electromagnetic coupling is produced between the rod antenna 22A and the helical antenna 22B.

Thus, the helical antenna 22B only becomes operative as a single helical antenna which has its ground level at the ground of the circuit board 3 and the shielding case.

As described above, the rod antenna 22A is only operative as a monopole antenna when the rod antenna 22A is extended, while the helical antenna 22B is only operative as a single helical antenna when the rod antenna 22A is retracted. Consequently, favorable radiation can be realized in either of the two cases.

The foregoing structure can realize an antenna assembly and a portable radio apparatus which enable the rod antenna 22A and the helical antenna 22B to substantially independently operate, thus providing a large design freedom which allows free setting of parameters for the respective antennas.

Also, since the matching circuits 22F1 and 22F2 provided for the respective antennas 22A and 22B can be individually adjusted, the matching state can be optimized for each of the antennas.

For example, it is possible to arbitrarily employ different types of antennas having completely different input impedances, such as an antenna having a length corresponding to a one-quarter wavelength and an antenna having a length corresponding to a one-half wavelength.

(13) Thirteenth Embodiment

Figure 31:
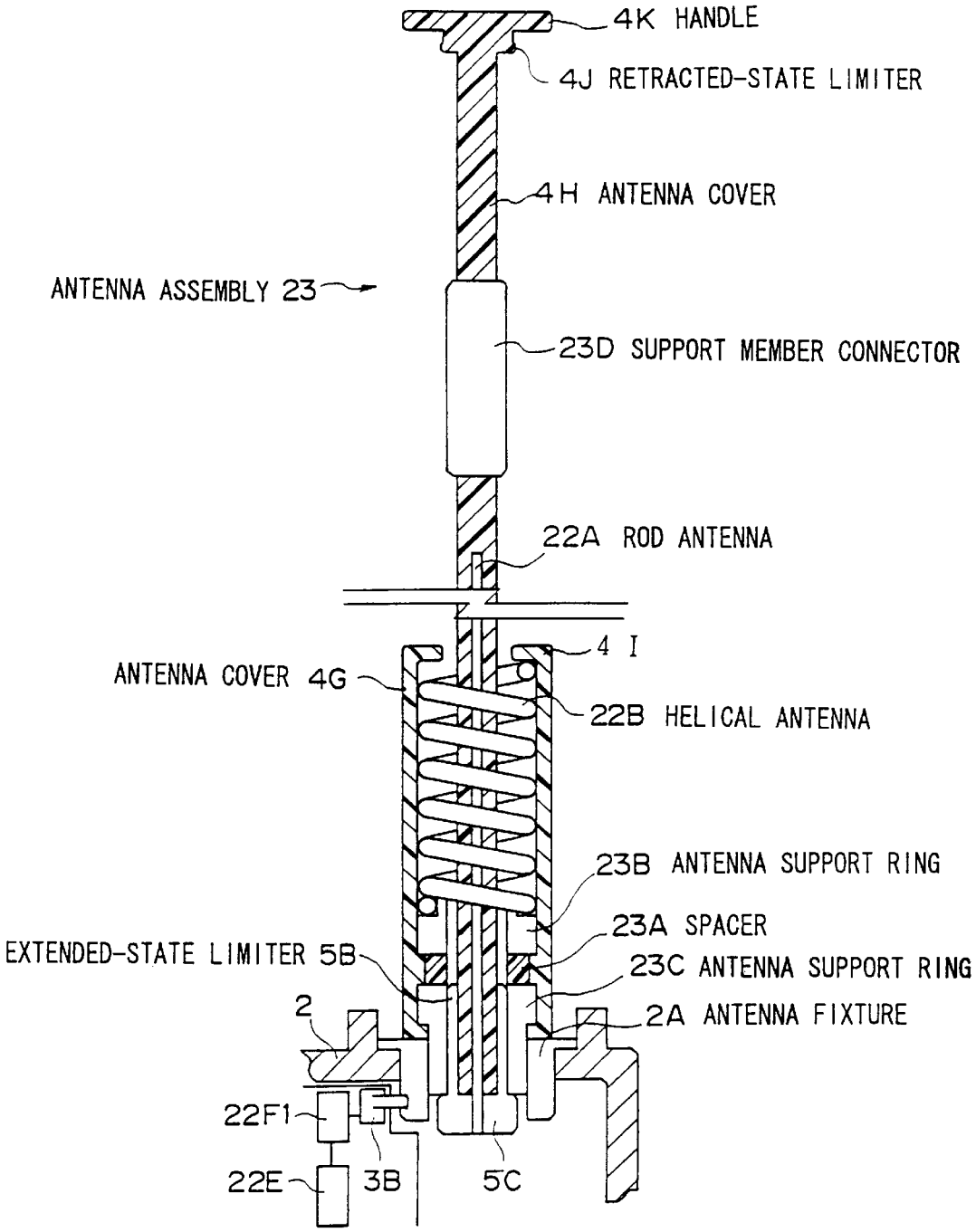
FIG. 31 is a cross-sectional view showing the connections of various portions when the antenna is used in the extended state in an antenna assembly according to a thirteenth embodiment of this invention.
Figure 32:
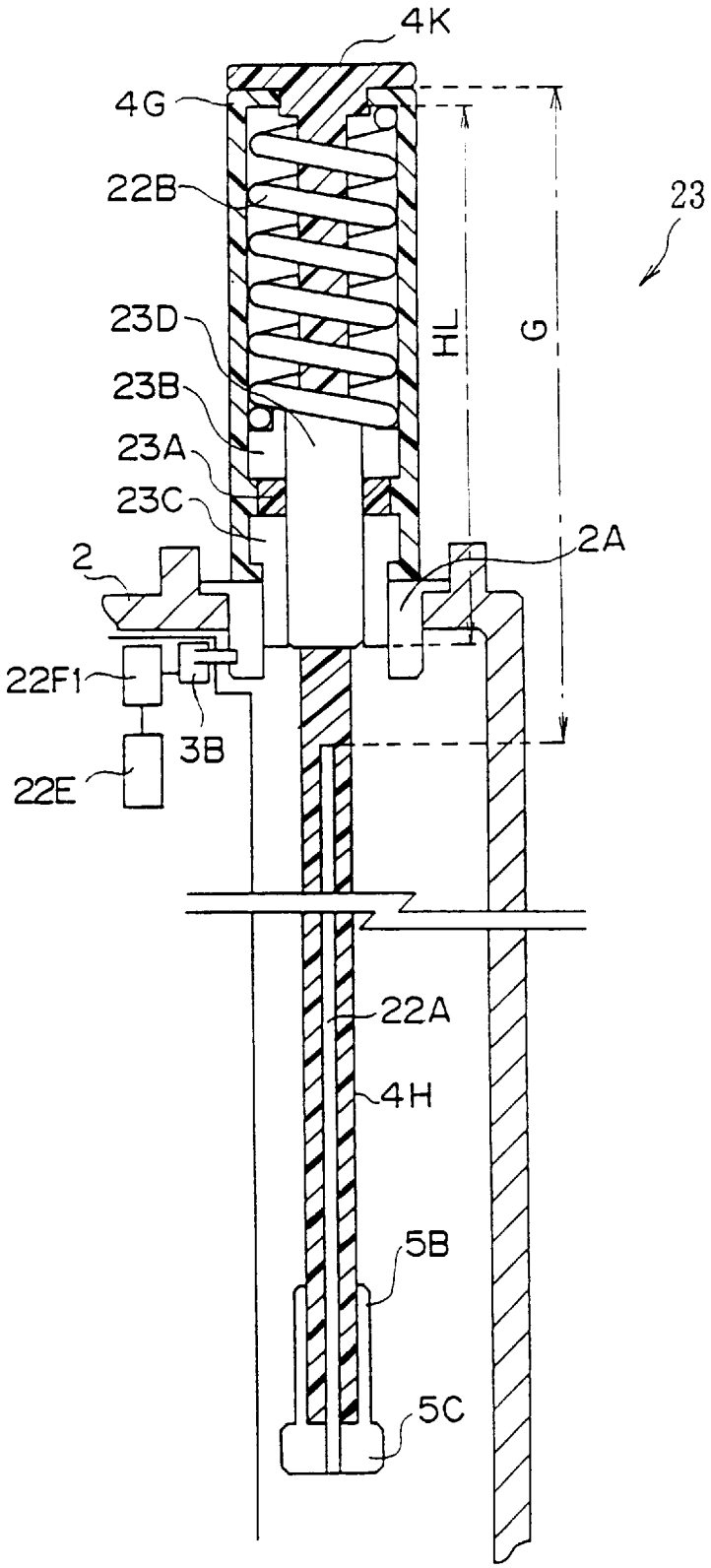
FIG. 32 is a cross-sectional view showing the connections of various portions when the antenna is used in the retracted state in the antenna assembly of FIG. 31.

In FIGS. 31 and 32, in which parts corresponding to those in FIGS. 29 and 30 are designated the same reference numerals, reference numeral 23 generally indicates an antenna assembly of this embodiment. The antenna assembly 23 is characterized by a mechanism which allows a single matching circuit 23F1 to be shared by a rod antenna 22A and a helical antenna 22B.

For this mechanism, the antenna assembly of this embodiment includes a tubular support member consisting of two metallic antenna support rings 23B and 23C which are placed on both sides of a non-metallic spacer 23A inside an antenna fixture 2A. In this structure, electrically and mechanically connected to the antenna fixture 2A is only the antenna support ring 23C, and the two antenna support rings 23B and 23C are electrically isolated completely from each other.

The helical antenna 22B used in this embodiment is electrically and mechanically connected at its lower end to the upper antenna support ring 23B, so that it is not directly powered from a power supply circuit 22F1 when the rod antenna 22A is extended.

Incidentally, in this structure, the helical antenna 22B could not be operated when the rod antenna 22A is retracted in the housing body 2, so that a support member connector 23D is provided coaxially with the rod antenna 22A for avoiding such inconvenience.

The support member connector 23D is fitted on an antenna cover 4H between the rod antenna 22A and a handle 4K. The outer diameter of the support member connector 23D is selected substantially equal to the inner diameter of the antenna support ring 23B. Also, the support member connector 23D is positioned so as to be brought into contact with the antenna support rings 23B and 23C when the rod antenna 22A is pushed into the housing body 2. In this way, when the rod antenna 22A is retracted, the outer periphery of the support member connector 23D is slidingly brought into contact with the inner periphery of the antenna support rings 23B and 23C to achieve electrical connection therebetween. Stated another way, the support member connector 23D serves as a switching mechanism.

With the foregoing structure, the operation of the antenna assembly 23 will be described for two cases: when the antenna assembly 23 is used extended from a housing body 2 (extended state) and when it is used left retracted in the housing body 2 (retracted state).

First, when the antenna is used in the extended state (FIG. 31), an extended-state limiter 5B arranged on a lower portion of the rod antenna 22A is engaged with the antenna support ring 23C. This results in supplying an RF signal to the rod antenna 22A mechanically and electrically connected to the extended-state limiter 5B and a stopper 5C.

Incidentally, since the helical antenna 22B is electrically isolated completely from the antenna support ring 23C by the spacer 23A, it will not operate as an antenna.

The rod antenna 22A is thus operative as a monopole antenna which has its ground level at the ground of a circuit board 3 and a shielding case. Incidentally, the stopper 5C is provided at the lower end of the rod antenna 22A also for preventing the user from pulling out the antenna assembly 23.

On the other hand, when the antenna assembly 23 is used in the retracted state (FIG. 32), a retracted-state limiter 4J is mechanically connected to an antenna fixture 4I formed in the top of an antenna cover 4G in a secure manner to define an antenna housing position.

When the rod antenna 22A is pushed into the housing body 2 and fully retracted therein, the support member connector 23D is brought into contact with the two support rings 23B and 23C to achieve electrical connection therebetween. This causes the helical antenna 22B to be powered through the antenna support ring 23C, support member connector 23D, and antenna support ring 23B, whereby the helical antenna 22B becomes operative as an antenna.

In this state, since the rod antenna 22A is fully retracted such that its upper end is located below the antenna support ring 23C, no electromagnetic coupling is produced between the rod antenna 22A and the helical antenna 22B, whereby the rod antenna 22A is not operative as an antenna.

Thus, the helical antenna 22B only becomes operative as a single helical antenna which has its ground level at the ground of the circuit board 3 an d the shielding case.

As described above, the rod antenna 22A is only operative as a monopole antenna when the rod antenna 22A is extended, while the helical antenna 22B is only operative as a single helical antenna when the rod antenna 22A is retracted. Consequently, favorable radiation can be realized in both cases when the antenna is extended and the antenna is retracted.

The foregoing structure can realize an antenna assembly and a portable radio apparatus which only requires a simple switching mechanism because the matching circuit 22F1 is shared by the rod antenna 22A and the helical antenna 22B.

(14) Fourteenth Embodiment

Figure 33:
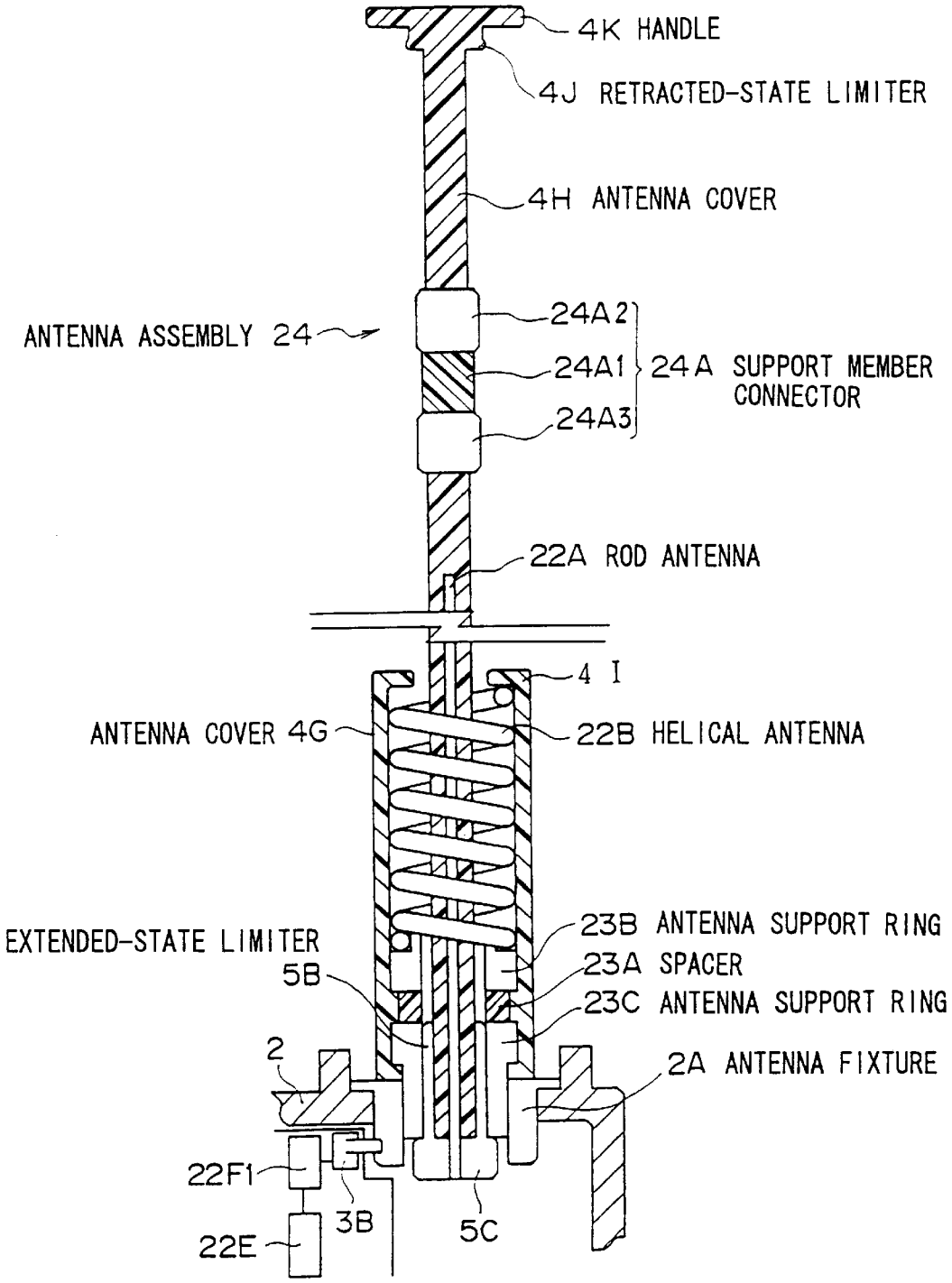
FIG. 33 is a cross-sectional view showing the connections of various portions when the antenna is used in the extended state in an antenna assembly according to a fourteenth embodiment of this invention.
Figure 34:
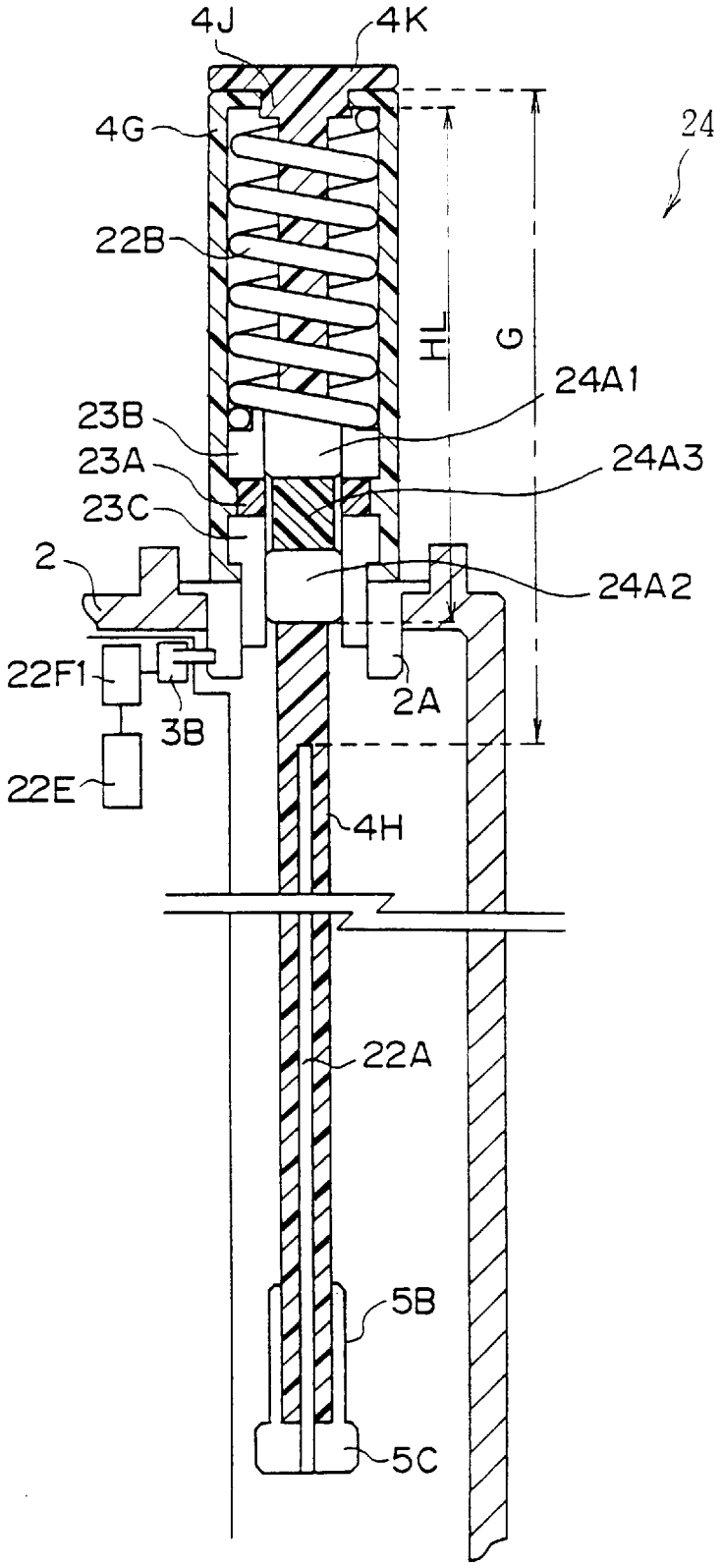
FIG. 34 is a cross-sectional view showing the connections of various portions when the antenna is used in the retracted state in the antenna assembly of FIG. 33.

In FIGS. 33 and 34, in which parts corresponding to those in FIGS. 31 and 32, reference numeral 24 generally indicates an antenna assembly of this embodiment.

The antenna assembly 24 has a similar structure to the antenna assembly 23 of FIG. 31, except that a matching circuit 24A1 is provided in a support member connector 24A. More specifically, the antenna assembly 24 features that the support member connector 24A is divided into an upper connector half 24A2 and a lower connector half 24A3, and the support connector built-in matching circuit 24A1 is arranged between these two connector halves. The matching circuit 24A1 is made of a conductive material and electrically connects the upper connector half 24A2 with the lower connector half 24A3.

With the foregoing structure, the operation of the antenna assembly 24 will be described for two cases: when the antenna assembly 24 is used extended from a housing body 2 (extended state) and when it is used left retracted in the housing body 2 (retracted state).

First, when the antenna assembly 24 is used in the extended state (FIG. 33), an extended-state limiter 5B arranged on a lower portion of the rod antenna 22A is engaged with an antenna support ring 23C. This results in supplying an RF signal to the rod antenna 22A which is mechanically and electrically connected to an extended-state limiter 5B and a stopper 5C.

Incidentally, since the helical antenna 22B is electrically isolated completely from the antenna support ring 23C by the spacer 23A, it will not operate as an antenna.

The rod antenna 22A is thus operative as a monopole antenna which has its ground level at the ground of a circuit board 3 and a shielding case. Incidentally, the stopper 5C provided at the lower end of the rod antenna 22A is also useful for preventing the user from pulling out the antenna assembly 23.

On the other hand, when the antenna assembly 23 is used in the retracted state (FIG. 34), a retracted-state limiter 4J is mechanically connected to an antenna fixture 4I formed in the top of an antenna cover 4G in a secure manner to define an antenna housing position.

When the rod antenna 22A is pushed into the housing body 2 and fully retracted therein, the antenna support rings 23B and 23C are electrically connected to each other through the upper connector half 24A2 and the lower connector half 24A3 of the support member connector 24A. This causes the helical antenna 22B to be powered through the antenna support ring 23C, support member connector 23A, and antenna support ring 23B, whereby the helical antenna 22B becomes operative as an antenna.

It should be noted that input impedance viewed from a power supply spring 3B will not vary irrespective of whether the rod antenna 22A is extended or retracted by virtue of the support connector built-in matching circuit 24A1 arranged between the upper and lower connector halves 24A2 and 24A3.

Since the rod antenna 22A is fully retracted such that its upper end is located below the antenna support ring 23C, no electromagnetic coupling is produced between the rod antenna 22A and the helical antenna 22B, whereby the rod antenna 22A is not operative as an antenna.

Thus, the helical antenna 22B is only operative as a single helical antenna which has its ground level at the ground of the circuit board 3 and the shielding case.

As described above, the rod antenna 22A is only operative as a monopole antenna when the rod antenna 22A is extended, while the helical antenna 22B is only operative as a single helical antenna when the rod antenna 22A is retracted. Further, since input impedance presented when the rod antenna 22A is extended is matched with input impedance presented when the rod antenna 22A is retracted, favorable radiation can be realized in either of the two cases.

The foregoing structure can realize an antenna assembly and a portable radio apparatus which only requires a simple switching mechanism because the matching circuit 22F1 is shared by the rod antenna 22A and the helical antenna 22B.

Also, since the matching circuit 24A1 is built in the support member connector 24A which is arranged coaxially with the rod antenna 22A and moved together with extension and retraction of the rod antenna 22A, it is also possible to use two types of antennas having completely different input impedances.

(15) Fifteenth Embodiment

Figure 35:
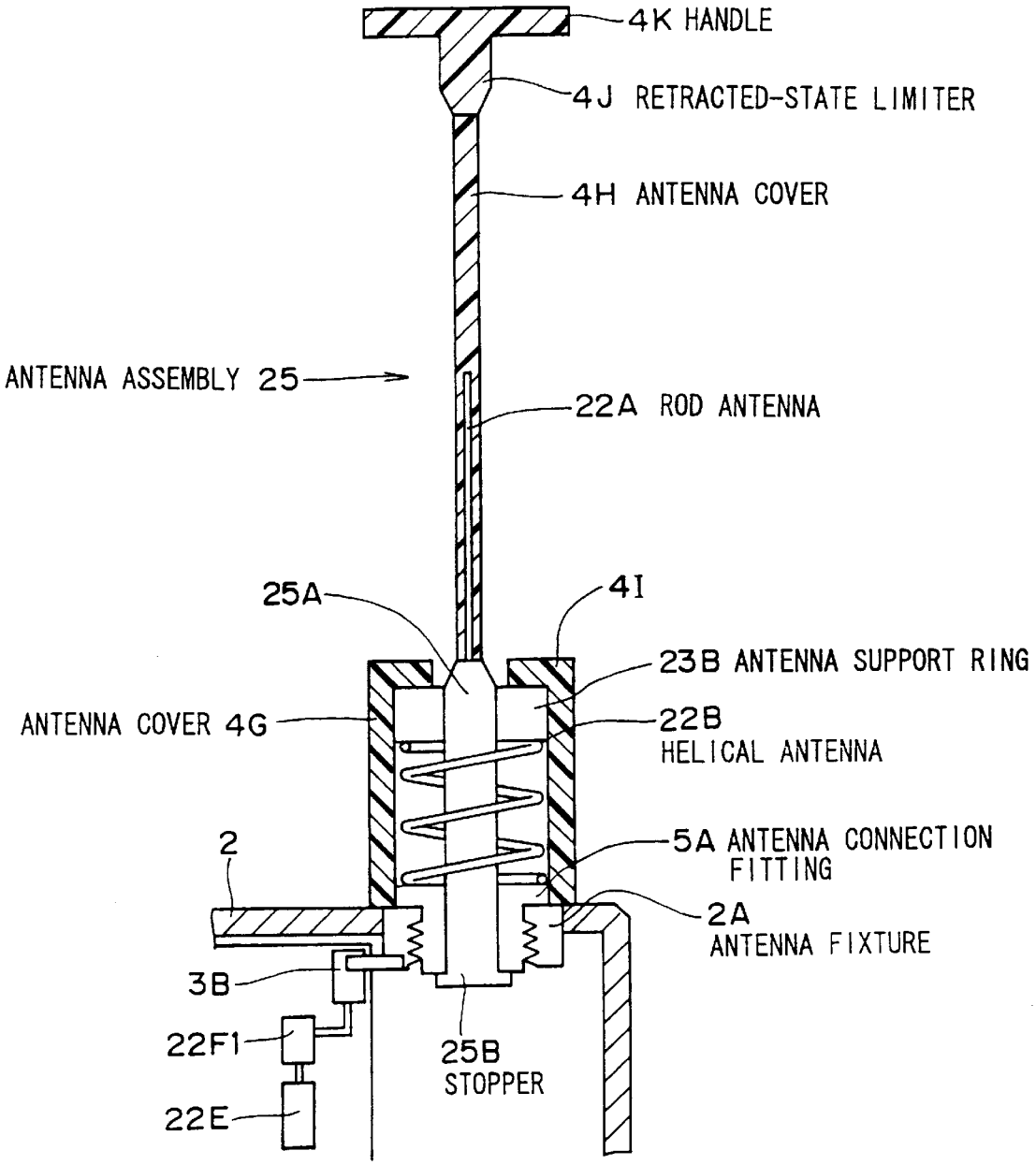
FIG. 35 is a cross-sectional view showing the connections of various portions when the antenna is used in the extended state in an antenna assembly according to a fifteenth embodiment of this invention.
Figure 36:
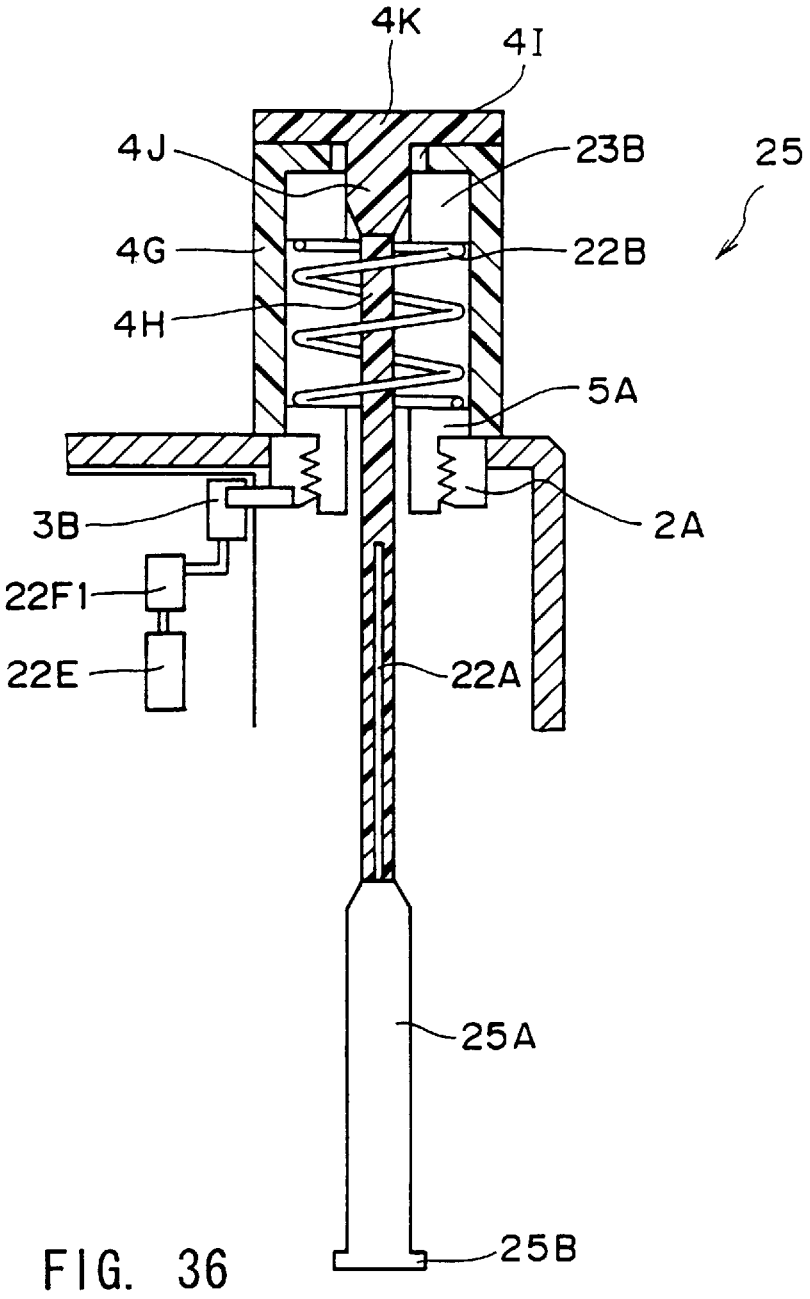
FIG. 36 is a cross-sectional view showing the connections of various portions when the antenna is used in the retracted state in the antenna assembly of FIG. 35.

In FIGS. 35 and 36, in which parts corresponding to those in FIGS. 31 and 32, reference numeral 24 generally indicates an antenna assembly of this embodiment.

The antenna assembly 25 has a similar structure to the antenna assembly of FIG. 31, except that a member corresponding to the support member connector 23D of FIG. 31 is provided in the lower portion of the rod antenna.

Here, the lower end of the helical antenna 22B is electrically and mechanically connected to the antenna connection fitting 5A. The upper end of the helical antenna 22B is electrically and mechanically connected to the antenna support ring 23B.

An antenna extended-state limiter 25A having the same diameter as the inside diameter of a through hole provided in the antenna support ring 23B and the antenna connection fitting 5A is electrically and mechanically connected to a base portion of the rod antenna 22A which operates as a monopole antenna when the antenna is extended. The antenna extended-state limiter 25A is the limiter for fixing the antenna when it is extended, and which corresponds to the support member connector 23D.

Usually, the antenna extended-state limiter 25A is combined with the antenna extended-state stopper 25B by metal, and is fixed so that the rod antenna 22A passes through the inside. The rod antenna 22A is mechanically fixed at the lower end portion of the antenna extended-state stopper 25A by using a technique such as caulking.

With the foregoing structure, the operation of the antenna assembly 25 will be described for two cases: when the antenna is used extended from a housing body 2 (extended state) and when it is used left retracted in the housing body 2 (retracted state).

First, when the antenna is used in the extended state (FIG. 35), the rod antenna 22A enters in the state where it is powered via the stopper 25B, the antenna extended-state limiter 25A, and the antenna connection fitting 5A, and then operates as a monopole antenna which has its ground level at the ground of a circuit board 3 and a shielding case.

Incidentally, since the upper end and the lower end of the helical antenna 22B short by the antenna extended-state limiter 25A, the helical antenna 22B is not operate as an antenna at this time. Therefore, it is easy to design an antenna because only a monopole antenna needs to be considered in designing.

Further, the inside diameter of the antenna support ring 23B which is the upper end of the helical antenna 22B and the outside diameter of the antenna extended-state limiter 25A are designed to be equal, so that rainwater and so on will not enter into the housing body.

On the other hand, when the antenna is used in the retracted state (FIG. 36), the retracted-state limiter 4J is mechanically connected to the antenna fixture 4I provided in the antenna cover 4G to define an antenna housing position.

When the antenna is pushed into the housing body 2 and fully retracted therein, the helical antenna 22B is powered via the antenna connection fitting 5A and the antenna fixture 2A to operate as an antenna. Incidentally, since the rod antenna 22A is positioned at a lower portion than the antenna fixture 2A, there is no electromagnetic coupling and the rod antenna 22A does not operate.

Only the helical antenna 22B is thus operative as a helical antenna which has its ground level at the ground of a circuit board 3 and a shielding case.

In this way, when the antenna is extended, only the rod antenna 22A is operative as a monopole antenna, and when the antenna is retracted, only the helical antenna 22B is operative as a helical antenna. Therefore, favorable radiation can be realized in either of the two cases.

With the above construction, when the antenna is retracted, only the helical antenna 22B is operated, and when the antenna is extended, the upper end and the lower end of the helical antenna 22B short by the antenna extended-state limiter 25A which is connected with the rod antenna 22A to move, so as to operate only the rod antenna 22A. Therefore, an antenna assembly, which is designed easily and which can realize the favorable characteristic of not having unnecessary modes in the desired radio communication frequency, can be obtained.

Further, the outside diameter of the retracted-state limiter 4J and the antenna extended-state limiter 25A is matched to the inside diameter of the through hole provided in the antenna support ring 23B, to that an antenna assembly, which can prevent the inflow of rainwater, etc. not only in the extended-state but also in the retracted-state, can be realized.

Accordingly, by retracting the antenna when it is carried, the a portable radio apparatus having a high quality of communication, which has a superior portability and which can obtain the favorable antenna characteristics that an antenna can be extended to the position where the body effect is hardly received in communication, can be obtained.

(16) Other Embodiments

The embodiments described above have dealt with the case where the housing body is made of a non-metallic material. However, the present invention is not limited this, but the housing body can be made of a metallic material. However, if a metallic housing body is employed, a spacer or the like must be inserted to prevent the antenna fixture 2A from directly conducting with the metallic housing body.

Also, the embodiments discussed above have dealt with the case where this invention is applied to an antenna assembly having a rod antenna of the simplest structure. However, the present invention is not limited to this particular type of rod antenna, but can be applied to an antenna assembly which employs a rod antenna of two-stage or multiple-stage retractable type. If a multiple-stage retractable rod antenna is employed, a housing space required therefore can be further reduced.

Further, the embodiments discussed above have dealt with the case where the rod antennas 11A, 16A, 17A, and 22A have been shown as made of linear wire materials. However, the present invention is not limited to this particular form of rod antenna. Alternatively, an employed rod antenna can be made of helical windings of small diameter formed in a rod shape.

Further, the embodiments discussed above have dealt with the case where a transmitter/receiver circuit is connected to the power supply circuit 3A and the matching circuits 22F1, 22F2. However, the present invention is not limited to this, but can be applied to a circuit only having a transmitter circuit or a receiver circuit connected thereto.

Further, the embodiments discussed above have dealt with the case where the matching circuits 22F1, 22F2, or 24A1 are provided at a previous stage or a rear stage of the power supply spring 3B to match input impedance for two kinds of switchably used antennas. However, the present invention is not limited to this, and does not require such a matching circuit depending on a switched antenna.

Further, the embodiments discussed above have dealt with the case, when a rod antenna is retracted, a helical antenna attached to a movable portion of the antenna assembly is electrically connected to a helical antenna fixed to the housing body. However, the present invention is not limited to this, but the antenna to be connected to the helical antenna fixed to the housing body can be other than the helical type.

Further, the embodiments discussed above have dealt with the case where a handle and a retracted-state limiter are integrally formed or a case, contrary to this. The handle and the retracted-state limiter are separately formed. However, the formation of the handle portion can be either of the two options.

Further, the embodiments discussed above have dealt with the case where the matching circuit 24A1 is arranged in the support member connector 24A for electrically connecting the antenna support ring 23C for supporting the helical antenna 22B with the antenna support ring 23B for supporting the rod antenna 22A, when the rod antenna 22A is retracted. However, the present invention is not limited to this, but the matching circuit can be arranged in contact with a connector which functions when the rod antenna 22A is extended, i.e., between the extended-state limiter 5B for stopping the rod antenna 22A and the antenna support ring 23C.

Further, the embodiments discussed above have dealt with the case where a non-metallic spacer is inserted between an antenna support ring for supporting a helical antenna and another antenna support ring for supporting a rod antenna for providing a switching mechanism on a movable shaft of the antenna assembly. However, the present invention is not limited to this, but two grooves can be formed in an antenna cover for fixedly fitting the two metallic support rings, such that they are electrically isolated.

Further, the embodiments discussed above have dealt with the case where, for providing a switching mechanism on a movable shaft of the antenna assembly, the outside dimension of the support member connector 23D, constituting the switching mechanism, is selected substantially equal to the inner diameter of through holes through which the support member connector 23D passes. However, the present invention is not limited to this. If a resilient structure or the like is arranged inside the through hole, formed on the side to which the rod antenna 22A is fixed (i.e., on the housing body side), the inner diameter of the through hole may be smaller than the outside dimension of the support member connector 23D. In this way, the support member connector 23D can be mechanically fixed to the antenna support ring 23C while maintaining a contact therebetween with a certain degree of resilient force.

Further, the embodiments discussed above have dealt with the case where, for providing a switching mechanism on a movable shaft of the antenna assembly, the support member connector 23D constituting the switching mechanism has a uniform size over the whole length. However, the present invention is not limited to this, but the diameter of a through hole on the side to which the helical antenna 22B is fixed (i.e., on the side of the handle for pulling the rod antenna) and the size of the upper connector half 24A2, which is an internal region of this portion, may be larger than the through hole formed on the side to which the rod antenna 22A is fixed (i.e., on the housing body side). In this way, the support member connector 24A will have a wider portion at its lower end which functions as a stopper when the rod antenna is retracted.

Further, the embodiments discussed above have dealt with a portable telephone as a radio apparatus utilizing the antenna assembly. However, the present invention is not limited to this, but can be applicable to other apparatuses.

We claim:

1. An antenna assembly comprising:

a helical antenna; and a rod antenna extending through an inside of said helical antenna in an axial direction thereof and being slidably mounted to extend and retract in said axial direction, wherein said rod antenna includes a conductive portion, and when in a retracted position a distal end of said conductive portion of said rod antenna is positioned below a proximal end of said helical antenna, and when in an extended position a proximal end of said conductive portion of said rod antenna is electrically connected to a distal end of said helical antenna, thereby connecting said helical antenna and said rod antenna in series, and wherein said rod antenna further includes a non-metallic bar member having a length greater than an axial length of said helical antenna, and connected to said distal end of said conductive portion of said rod antenna so that said bar member is placed inside said helical antenna when said rod antenna is in said retracted position for electrically isolating said rod antenna from said helical antenna, and a helical antenna assembly includes a first helical antenna and a second helical antenna fixed to a distal end of said non-metallic bar member so that said second helical antenna is electrically isolated from said conductive portion of said rod antenna, and when said rod antenna is in said retracted position said distal end of said first helical antenna is electrically and directly connected via an antenna fixture to a proximal end of said second helical antenna, thereby connecting said first and second helical antennas in series to operate as said helical antenna assembly.

2. An antenna assembly comprising:

a fixed helical antenna including a first conductive terminal;

a rod antenna extending through an inside of said fixed helical antenna in an axial direction thereof and being slidably mounted for movement in said axial direction between an extended position and a retracted position, wherein said rod antenna is electrically isolated from said fixed helical antenna in both said extended position and said retracted position and includes:

a conductive portion formed in a proximal portion of said rod antenna, wherein said conductive portion terminates in a second conductive terminal at a proximal end of said conductive portion of said rod antenna, and wherein when in said retracted position a distal end of said conductive portion of said rod antenna is positioned below a proximal end of said fixed helical antenna;

a non-conductive bar member having a length greater than an axial length of said fixed helical antenna so that said non-conductive bar member is placed inside said fixed helical antenna when said rod antenna is in said retracted position for electrically isolating said rod antenna from said fixed helical antenna; and switching means for switching a power supply to one of said fixed helical antenna and said rod antenna in accordance with a position of said rod antenna.

3. The antenna assembly according to claim 2, wherein said switching means includes a plurality of electronic switches.

4. The antenna assembly according to claim 2, wherein said switching means includes a conductive cylindrical connecting member arranged coaxially with said second rod antenna for electrically connecting said first conductive terminal with said second conductive terminal when said rod antenna is in said retracted position.

5. The antenna assembly according to claim 2, wherein said switching means further includes impedance matching means.

6. The antenna assembly according to claim 4, further comprising impedance matching means for matching an impedance between said rod antenna and said fixed helical antenna.

7. An antenna assembly comprising:

a fixed helical antenna formed in a cylindrical shape having a constant first diameter including first and second annular conductive terminals having a central aperture of a second diameter located respectively at distal and proximal ends thereof;

a rod antenna extending through an inside of said fixed helical antenna in an axial direction thereof and being slidably mounted to extend and retract in said axial direction, wherein said rod antenna includes:

a conductive portion formed in a proximal portion of said rod antenna, wherein said conductive portion terminates in a third conductive terminal of a length substantially equal to an axial length of said fixed helical antenna and having a diameter equal to said second diameter;

a non-conductive bar member formed in a distal portion of said rod antenna having a length greater than an axial length of said fixed helical antenna so that said non-conductive bar member is placed inside said fixed helical antenna when said rod antenna is in said retracted position for electrically isolating said rod antenna from said fixed helical antenna, wherein said first and second annular conductive terminals are electrically shorted by said third conductive terminal of said rod antenna and said third conductive terminal forms an environmental seal with said first conductive terminal when said rod antenna is in said extended position.

8. An antenna assembly comprising:

a fixed helical antenna; and a rod antenna positioned coaxially with said helical antenna, wherein said rod antenna is formed of a conductive fixed cylindrical portion placed inside said fixed helical antenna, electromagnetically coupled therewith and electrically insulated therefrom, and a movable portion extending through an inside of said fixed cylindrical portion, said movable portion being slidably mounted to extend and retract in an axial direction, and wherein a proximal end of said movable portion is electrically connected to a distal end of said conductive fixed cylindrical portion when said movable portion of said rod antenna is in an extended position.

9. The antenna assembly according to claim 8, wherein said movable portion further includes a conductive portion, and wherein a distal end of said conductive portion of said movable portion is placed inside said helical antenna when said movable portion is in a retracted position.

10. The antenna assembly according to claim 8, wherein a part of a conductive portion of said movable portion is placed inside said helical antenna when said movable portion is in a retracted position.

11. The antenna assembly according to claim 8, further comprising:

a ground conductor provided between said fixed cylindrical portion and said movable portion of said rod antenna.

12. A portable radio apparatus comprising:

an antenna assembly including:

a helical antenna, and a rod antenna extending through an inside of said helical antenna in an axial direction thereof and being, slidably mounted to extend and retract in said axial direction, wherein said rod antenna includes a conductive portion, and wherein when in a retracted position a distal end of said conductive portion of said rod antenna is positioned below a proximal end of said helical antenna, and wherein when in an extended position a proximal end portion of said conductive portion of said rod antenna is electrically connected to a distal end of said helical antenna, thereby connecting said helical antenna and said rod antenna in series, and wherein said rod antenna further includes a non-metallic bar member having a length greater than an axial length of said helical antenna, and connected to said distal end of said conductive portion of said rod antenna so that said bar member is placed inside said helical antenna when said rod antenna is in said retracted position for electrically isolating said rod antenna from said helical antenna, and a helical antenna assembly includes a first helical antenna and a second helical antenna fixed to a distal end of said non-metallic bar member so that said second helical antenna is electrically isolated from said conductive portion of said rod antenna, and when said rod antenna is in said retracted position said distal end of said first helical antenna is electrically and directly connected via an antenna fixture to a proximal end of said second helical antenna, thereby connecting said first and second helical antennas in series to operate as said helical antenna assembly;

a housing for supporting said antenna assembly and for retracting said rod antenna therein; and a power supply circuit for supplying power to said antenna assembly.

13. A portable radio apparatus comprising:

an antenna assembly including:

a fixed helical antenna including a first conductive terminal, and a rod antenna extending through an inside of said fixed helical antenna in an axial direction thereof and being slidably mounted to extend and retract in said axial direction, wherein said rod antenna is electrically isolated from said fixed helical antenna in both an extended position and a retracted position and includes:

a conductive portion formed in a proximal portion of said rod antenna, wherein said conductive portion terminates in a second conductive terminal at a proximal end of said conductive portion of said rod antenna, and wherein when in a retracted position a distal end of said conductive portion of said rod antenna is positioned below a proximal end of said fixed helical antenna, a non-conductive bar member having a length greater than an axial length of said fixed helical antenna so that said non-conductive bar member is placed inside said fixed helical antenna when said rod antenna is in said retracted position for electrically isolating said rod antenna from said fixed helical antenna; and switching means for switching a power supply to one of said fixed helical antenna and said rod antenna in accordance with a position of said rod antenna;

a housing for supporting said antenna assembly and for retracting said rod antenna therein; and a power supply circuit for supplying power to said antenna assembly.

14. A portable radio apparatus comprising:

a fixed helical antenna formed in a cylindrical shape having a constant first diameter including first and second annular conductive terminals having a central aperture of a second diameter located respectively at distal and proximal ends thereof;

a rod antenna extending through an inside of said fixed helical antenna in an axial direction thereof and being slidably mounted to extend and retract in said axial direction, wherein said rod antenna includes:

a conductive portion formed in a proximal portion of said rod antenna, wherein said conductive portion terminates in a third conductive terminal of a length substantially equal to an axial length of said fixed helical antenna and having a diameter equal to said second diameter, and a non-conductive bar member formed in a distal portion of said rod antenna having a length greater than an axial length of said fixed helical antenna so that said non-conductive bar member is placed inside said fixed helical antenna when said rod antenna is in said retracted position for electrically isolating said rod antenna from said fixed helical antenna, wherein said first and second annular conductive terminals are electrically shorted by said third conductive terminal of said rod antenna and said third conductive terminal forms an environmental seal with said first conductive terminal when said rod antenna is in said extended position.

15. A portable radio apparatus comprising:

an antenna assembly including:

a fixed helical antenna, and a rod antenna positioned on a same axis as said helical antenna, wherein said rod antenna includes a conductive fixed cylindrical portion placed inside said fixed helical antenna, electromagnetically coupled therewith and electrically insulated therefrom, and a movable portion extending inside said fixed cylindrical portion, said movable portion being slidably mounted to extend and retract along said axis, and wherein a proximal end of said movable portion is electrically connected to a distal end of said conductive fixed cylindrical portion when said movable portion is in an extended position;

a housing for supporting said antenna assembly and for retracting said rod antenna therein; and a power supply circuit for supplying power to said antenna assembly.

16. The portable radio apparatus according to claim 4, wherein said movable portion further includes a conductive portion, and wherein a distal end of said conductive portion of said movable portion is placed inside said helical antenna when said movable portion is in a retracted position.

17. The portable radio apparatus according to claim 15, wherein a part of a conductive portion of said movable portion is positioned inside said helical antenna when said movable portion is in a retracted position.

18. The portable radio apparatus according to claim 15, wherein a grounded conductor is provided between said fixed cylindrical portion and said movable portion of said rod antenna.

* * * * *